US009673546B2

(12) United States Patent
Okura et al.

(10) Patent No.: US 9,673,546 B2
(45) Date of Patent: Jun. 6, 2017

(54) CABLE HOLDING MEMBER, ELECTRICAL CONNECTION DEVICE, CONNECTOR DEVICE, FLAT CABLE

(71) Applicant: Panasonic Intellectual Property Management Co., Ltd., Osaka (JP)

(72) Inventors: Kenji Okura, Mie (JP); Chikara Ito, Mie (JP); Mitsuru Iida, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/021,212

(22) PCT Filed: Sep. 8, 2014

(86) PCT No.: PCT/JP2014/004595
§ 371 (c)(1),
(2) Date: Mar. 10, 2016

(87) PCT Pub. No.: WO2015/037216
PCT Pub. Date: Mar. 19, 2015

(65) Prior Publication Data

US 2016/0226168 A1 Aug. 4, 2016

(51) Int. Cl.
*H01R 4/16* (2006.01)
*H01R 12/77* (2011.01)

(52) U.S. Cl.
CPC ..... *H01R 12/774* (2013.01)

(58) Field of Classification Search
CPC ..... H01R 12/774
USPC ..... 439/499, 495, 492, 857, 856, 660, 637, 439/636, 354, 496
See application file for complete search history.

(56) References Cited

U.S. PATENT DOCUMENTS 5,897,394 A * 4/1999 Adachi ..... H01R 13/112 439/496
6,010,359 A * 1/2000 Etters ..... H01R 12/592 439/496
6,027,363 A 2/2000 Watt et al.
6,039,600 A * 3/2000 Etters ..... H01R 12/592 439/493

(Continued)

FOREIGN PATENT DOCUMENTS

JP 02-016587 U 2/1990
JP H04-322087 A 11/1992

(Continued)

OTHER PUBLICATIONS

International Search Report issued in Application No. PCT/JP2014/004595 dated Dec. 9, 2014, with English translation.

*Primary Examiner* — Abdullah Riyami
*Assistant Examiner* — Nelson R Burgos-Guntin
(74) *Attorney, Agent, or Firm* — McDermott Will & Emery LLP

(57) ABSTRACT

The connector device of one embodiment of the present invention includes an electrical connection device and a receptacle connector. The cable holding member includes a supporting part and a wall part. The supporting part includes a supporting face for supporting a flat cable in a folded state. The wall part is provided to the supporting part so as to be on a side of the flat cable in a width direction of the flat cable supported on the supporting part. A groove for receiving a first protrusion of the flat cable is provided to an internal face of the wall part.

19 Claims, 17 Drawing Sheets

(56) References Cited

U.S. PATENT DOCUMENTS 6,086,412 A * 7/2000 Watt ..... H01R 12/87 439/496
6,299,476 B1 10/2001 Schramme et al.
6,394,834 B2 * 5/2002 Fujimoto ..... H01R 12/675 439/393
6,464,534 B1 * 10/2002 Schramme ..... H01R 12/771 439/353
6,626,698 B2 * 9/2003 Matsumura ..... H05K 1/118 439/496
6,755,683 B2 * 6/2004 Roberts ..... H01R 12/79 439/496
7,320,617 B1 * 1/2008 Bellato ..... H01R 12/62 439/496
7,530,839 B1 * 5/2009 Lee ..... H01R 12/592 439/496
7,796,399 B2 * 9/2010 Clayton ..... H05K 1/189 174/257
2002/0142647 A1 * 10/2002 Aoki ..... H01R 12/85 439/496
2003/0073345 A1 * 4/2003 LePottier ..... H01R 12/79 439/496
2006/0286859 A1 * 12/2006 Shimizu ..... H01R 12/771 439/496
2007/0010127 A1 * 1/2007 Takahira ..... H01R 12/88 439/495
2014/0017953 A1 * 1/2014 Iwano ..... H01R 12/777 439/660
2016/0099511 A1 * 4/2016 Ozeki ..... H01R 12/88 439/630
2016/0204533 A1 * 7/2016 Ogino ..... H01R 12/88 439/660
2016/0226168 A1 * 8/2016 Okura ..... H01R 12/774

FOREIGN PATENT DOCUMENTS

JP H11-329625 A 11/1999
JP 2007-004987 A 1/2007

* cited by examiner

CABLE HOLDING MEMBER, ELECTRICAL CONNECTION DEVICE, CONNECTOR DEVICE, FLAT CABLE

RELATED APPLICATIONS

This application is the U.S. National Phase under 35 U.S.C. §371 of International Application No. PCT/JP2014/004595, filed on Sep. 8, 2014, which in turn claims the benefit of Japanese Application No. 2013-187584, filed on Sep. 10, 2013, the disclosures of which are incorporated by reference herein.

TECHNICAL FIELD

The present invention would be generally directed to cable holding members, electrical connection devices, connector devices, and flat cables, and particularly directed to a cable holding member used for electrical connection of a flat cable such as a flexible printed substrate and a flexible flat cable, an electrical connection device, a connector device, and a flat cable.

BACKGROUND ART

In the past, there has been proposed an electrical connection device to be connected to a housing component for receptacle supporting multiple terminals so as to electrically interconnect multiple conductors of a flat cable to corresponding ones of the multiple terminals (e.g., disclosed in JP 2007-4987 A (hereinafter referred to as "Document 1")).

The electrical connection device disclosed in Document 1 is assembled by engaging a cable holder holding a flat cable with an engagement housing.

The cable holder includes a cable supporting part for supporting an exposed conductor of the flat cable in a folded state, and a tentative holding part attached to the cable supporting part in a rotative manner. An end of the flat cable is placed between the cable supporting part and the tentative holding part, and then the tentative holding part is rotated to a position in which the end of the flat cable is sandwiched between the cable supporting part and the tentative holding part. Thereby, the end of the flat cable is held. The flat cable is supported on the cable supporting part while the end is held by the tentative holding part, and the cable supporting part supporting the flat cable is fitted into the engagement housing. Thereby, the flat cable is fixed while being supported on the cable supporting part.

In the electrical connection device disclosed in Document 1, the end of the flat cable is sandwiched between the tentative holding part and the cable supporting part, and thereby the flat cable is held by the cable supporting part tentatively. When pull-out force acts on the flat cable, the tentative holding part may be moved, and then the flat cable may be displaced.

SUMMARY OF INVENTION

In view of the above insufficiency, the objective of the present invention would be to propose: a cable holding member offering an improved resistance to pull-out of a flat cable; an electrical connection device; a connector device; and a flat cable.

The cable holding member of one aspect of the present invention is a cable holding member for holding a flat cable in a strip shape including a substrate where multiple electrically conductive members are arranged side by side in a width direction of the flat cable, and at least one first protrusion protruding outward in the width direction of the flat cable from a side edge of the substrate in the width direction of the flat cable. The cable holding member includes: a supporting part including a supporting face for supporting the flat cable in a folded state; and at least one wall part provided to the supporting part so as to be on at least one of opposite sides of the flat cable in the width direction of the flat cable supported on the supporting part. At least one groove for receiving the at least one first protrusion of the flat cable is provided to the at least one wall part.

In the cable holding member of a preferable aspect, a second protrusion to be fitted into a hole provided to the flat cable is provided to the supporting part.

In the cable holding member of a preferable aspect, the at least one groove provided to the at least one wall part and the second protrusion are provided in different positions in a length direction of the flat cable which is perpendicular to the width direction of the flat cable.

In the cable holding member of a preferable aspect, the at least one groove provided to the at least one wall part includes a first groove provided to an internal face of the at least one wall part on a front side of the supporting part, and a second groove provided to the internal face of the at least one wall part on a rear side of the supporting part. With regard to the at least one wall part, the first groove and the second groove are provided respectively on the front side and the rear side of the supporting part to be in a same position when viewed in a thickness direction of the flat cable supported on the supporting part.

In the cable holding member of a preferable aspect, the at least one groove is shaped to receive the at least one first protrusion in a width direction of the flat cable.

In the cable holding member of a preferable aspect, an opening dimension of the at least one groove in a thickness direction of the flat cable supported on the supporting part is equal to a thickness of the flat cable.

In the cable holding member of a preferable aspect, the first housing has a hollow cylindrical or prism shape with opposite open ends one of which defines a fitting hole. A guiding part for guiding insertion of the cable holding member into the fitting hole in inserting the cable holding member into the fitting hole is provided to an end of the at least one wall part in an insertion direction in which the cable holding member is inserted into the fitting hole.

In the cable holding member of a preferable aspect, the at least one wall part includes a pair of wall parts. The pair of wall parts are provided to the supporting part so as to be on the opposite sides of the flat cable in the width direction of the flat cable supported on the supporting part.

The electrical connection device of one aspect of the present invention includes: the cable holding member of any one of the above aspects; and a first housing with a hollow cylindrical or prism shape with opposite open ends. The first housing holds the cable holding member which is inserted into the first housing via a first one of the open ends while the flat cable is supported thereon. The first housing makes, when a receptacle connector including a second housing supporting multiple terminals corresponding to the multiple electrically conductive members is inserted into the first housing via a second one of the open ends with the multiple terminals being directed to the first housing, electrical connection between the multiple terminals and corresponding ones of the multiple electrically conductive members.

The connector device of one aspect of the present invention includes: the electrical connection device of the above aspect; and the receptacle connector including the multiple terminals and the second housing which supports the multiple terminals and is to be removably connected to the electrical connection device. Each of the multiple terminals includes a fixed part, at least one contact, and at least one side wall which are formed integrally. The fixed part is fixed to the second housing. The at least one contact is in a plate spring shape which is to be electrically connected to a corresponding one of the multiple electrically conductive members when coming into elastic contact with the corresponding one of the multiple electrically conductive members while the electrical connection device is connected to the receptacle connector. The at least one side wall part is on a side of the at least one contact in a direction across a direction in which the at least one contact changes in shape.

In the connector device of a preferable aspect, each of the multiple electrically conductive members is present on a front side and a rear side of the supporting part in a state where the flat cable is supported on the supporting part. Each of the multiple terminals corresponding to the multiple electrically conductive members includes, as the at least one contact, a pair of contacts to be in contact with a corresponding one of the multiple electrically conductive members present on the front side and the rear side of the supporting part with the supporting part in-between.

In the connector device of a preferable aspect, the flat cable has part to be bent when supported on the supporting part, and the part being provided with a flexible structure for making the part more flexible than a remaining part of the flat cable.

In the connector device of a preferable aspect, the flexible structure is defined as a penetrating structure in which at least one of one or more holes and one or more cut-outs is formed at the part of the flat cable to be bent when supported on the supporting part so as to penetrate the flat cable in a thickness direction of the flat cable.

In the connector device of a preferable aspect, the flexible structure is defined as a thin structure obtained by making the part of the flat cable to be bent when supported on the supporting part be thinner than a remaining part of the flat cable.

In the connector device of a preferable aspect, a reinforcing part in a film shape is provided to a surface of the flat cable except the part to be bent when supported on the supporting part. The flexible structure is defined as a structure in which the reinforcing part is not provided to the surface of the flat cable with regard to the part to be bent when supported on the supporting part.

The flat cable of one aspect of the present invention is a flat cable in a strip shape to be supported in a folded state on the supporting part of the cable holding member of any one of the above aspects. The flat cable includes: a substrate where multiple electrically conductive members are arranged side by side in a width direction of the flat cable; and at least one first protrusion protruding outward in the width direction of the flat cable from a side edge of the substrate in the width direction of the flat cable. The substrate has part to be bent when supported on the supporting part, and the part is provided with a flexible structure for making the part more flexible than a remaining part of the substrate.

In the flat cable of a preferable aspect, the flexible structure is defined as a penetrating structure in which at least one of one or more holes and one or more cut-outs is formed at the part to be bent when supported on the supporting part so as to penetrate the flat cable in a thickness direction of the flat cable.

In the flat cable of a preferable aspect, the flexible structure is defined as a thin structure obtained by making the part to be bent when supported on the supporting part be thinner than a remaining part of the flat cable.

In the flat cable of a preferable aspect, a reinforcing part in a film shape is provided to a surface of the substrate except the part to be bent when supported on the supporting part. The flexible structure is defined as a structure in which the reinforcing part is not provided to the part to be bent when supported on the supporting part with regard to the surface of the substrate.

According to the aspects of the present invention, the flat cable is supported on the supporting part with the at least one first protrusion being in the at least one groove provided to the at least one wall part. Therefore, pull-out force acting on the flat cable can be received by the at least one groove to receive the at least one first protrusion, and therefore it is possible to realize the cable holding member with improved resistance to pull-out, the electrical connection device, the connector device, and the flat cable.

BRIEF DESCRIPTION OF DRAWINGS

Preferable embodiments of the present invention are described in more detail. Features of advantages of other embodiments of the present invention would be more understood in connection with the following detailed description and attached drawings.

DESCRIPTION OF EMBODIMENTS

Figure 1:
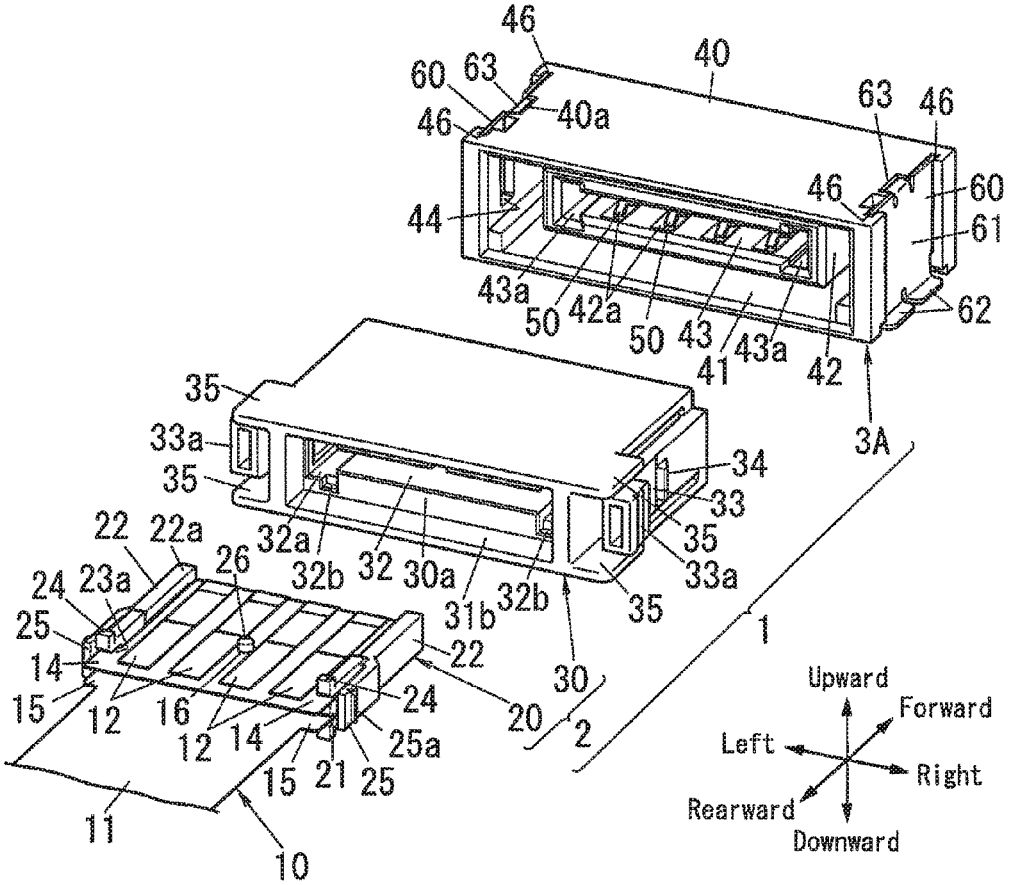
FIG. 1 is an exploded perspective view of a connector device including an electrical connection device of the present embodiment and a receptacle connector of a substrate-mounted type.
Figure 2A:
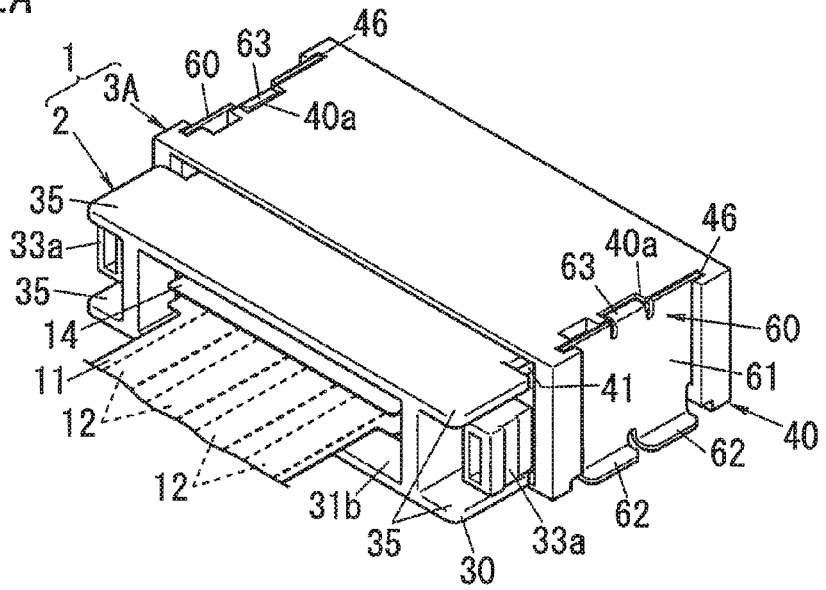
FIG. 2A is a perspective view of the connector device of the present embodiment wherein the electrical connection device and the receptacle connector are connected.
Figure 2B:
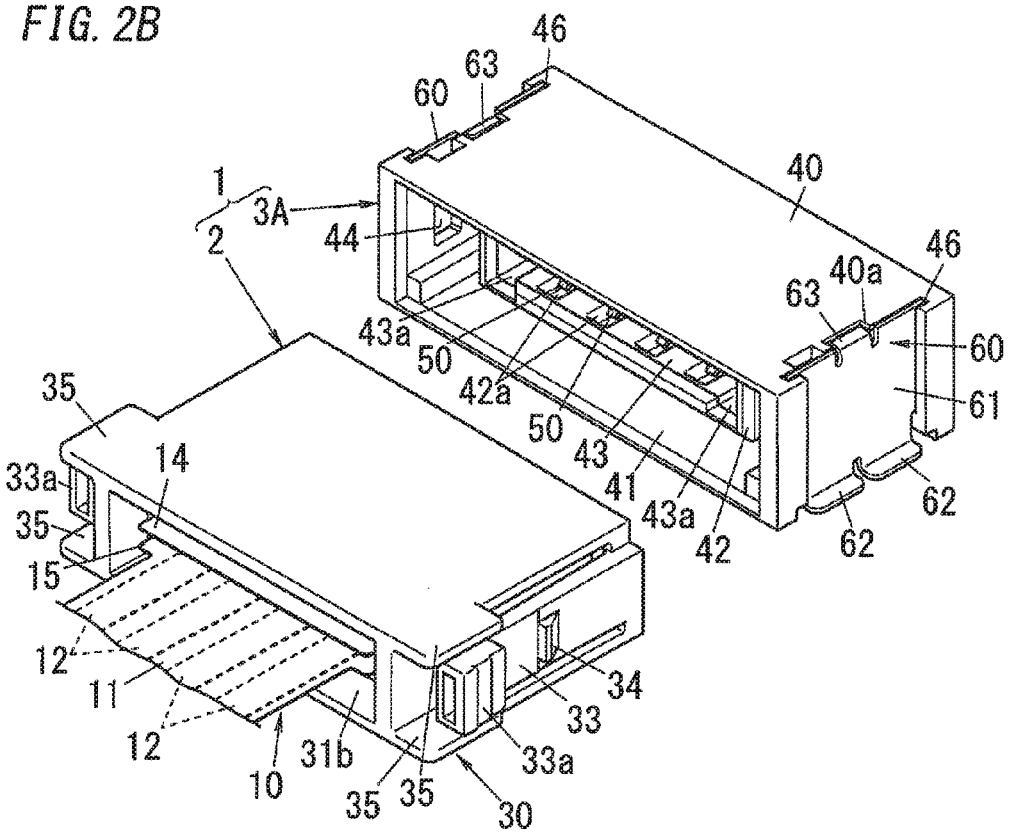
FIG. 2B is a perspective view of the connector device of the present embodiment wherein the electrical connection device is detached from the receptacle connector.
Figure 3:
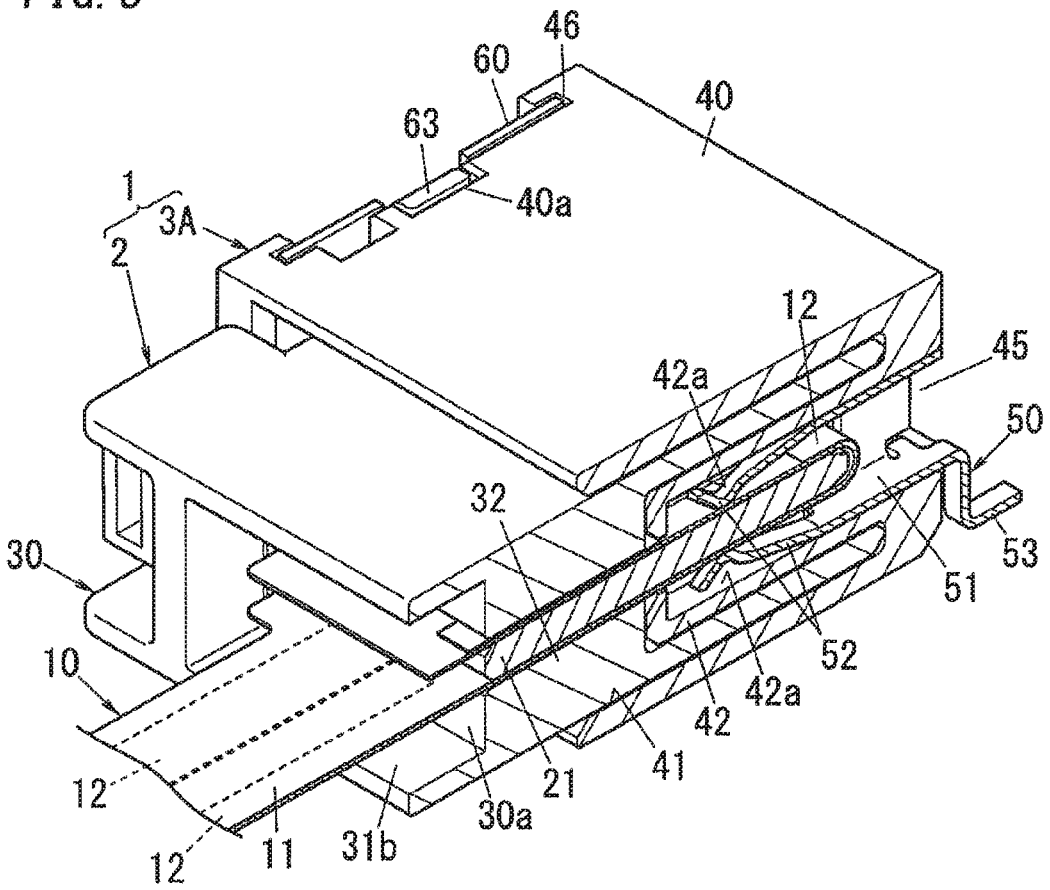
FIG. 3 is a perspective sectional view of the connector device of the present embodiment from the right side.
Figure 4:
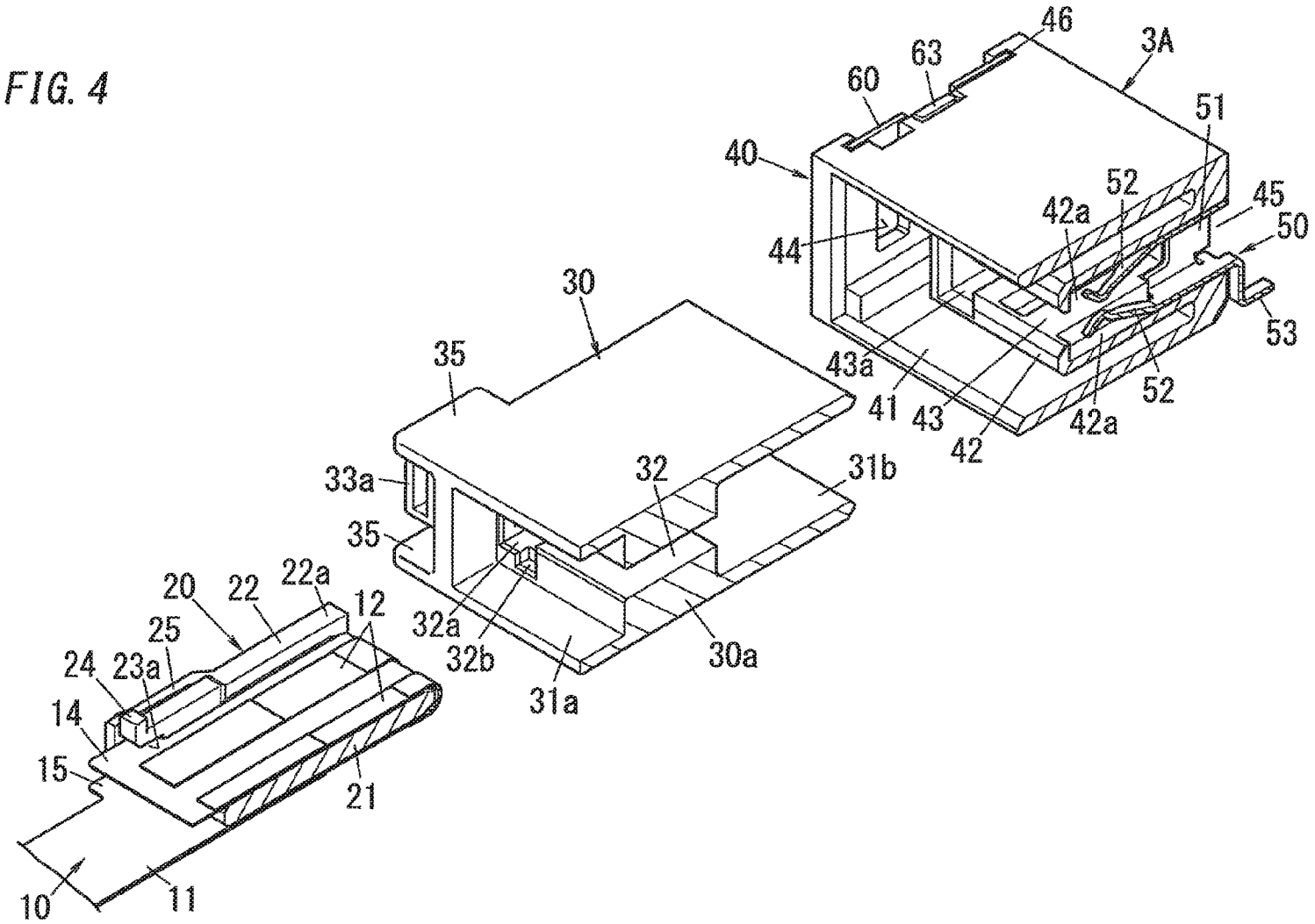
FIG. 4 is an exploded perspective sectional view of the connector device of the present embodiment from the right side.
Figure 5:
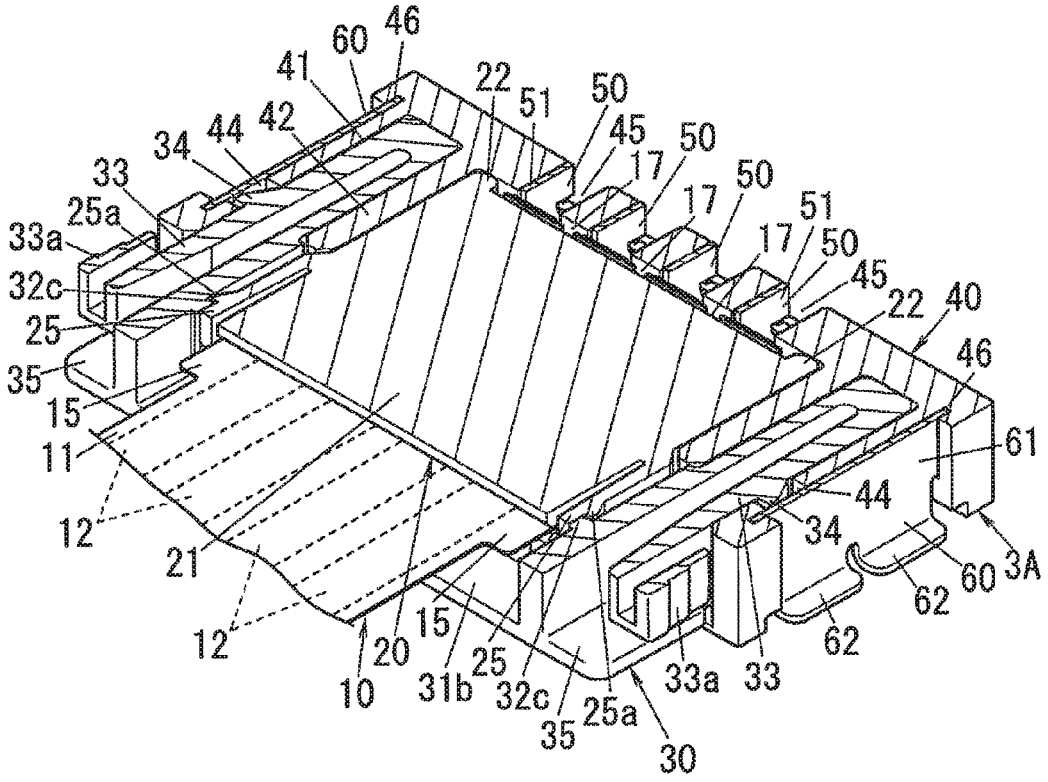
FIG. 5 is a perspective sectional view of the connector device of the present embodiment from the top side.
Figure 6:
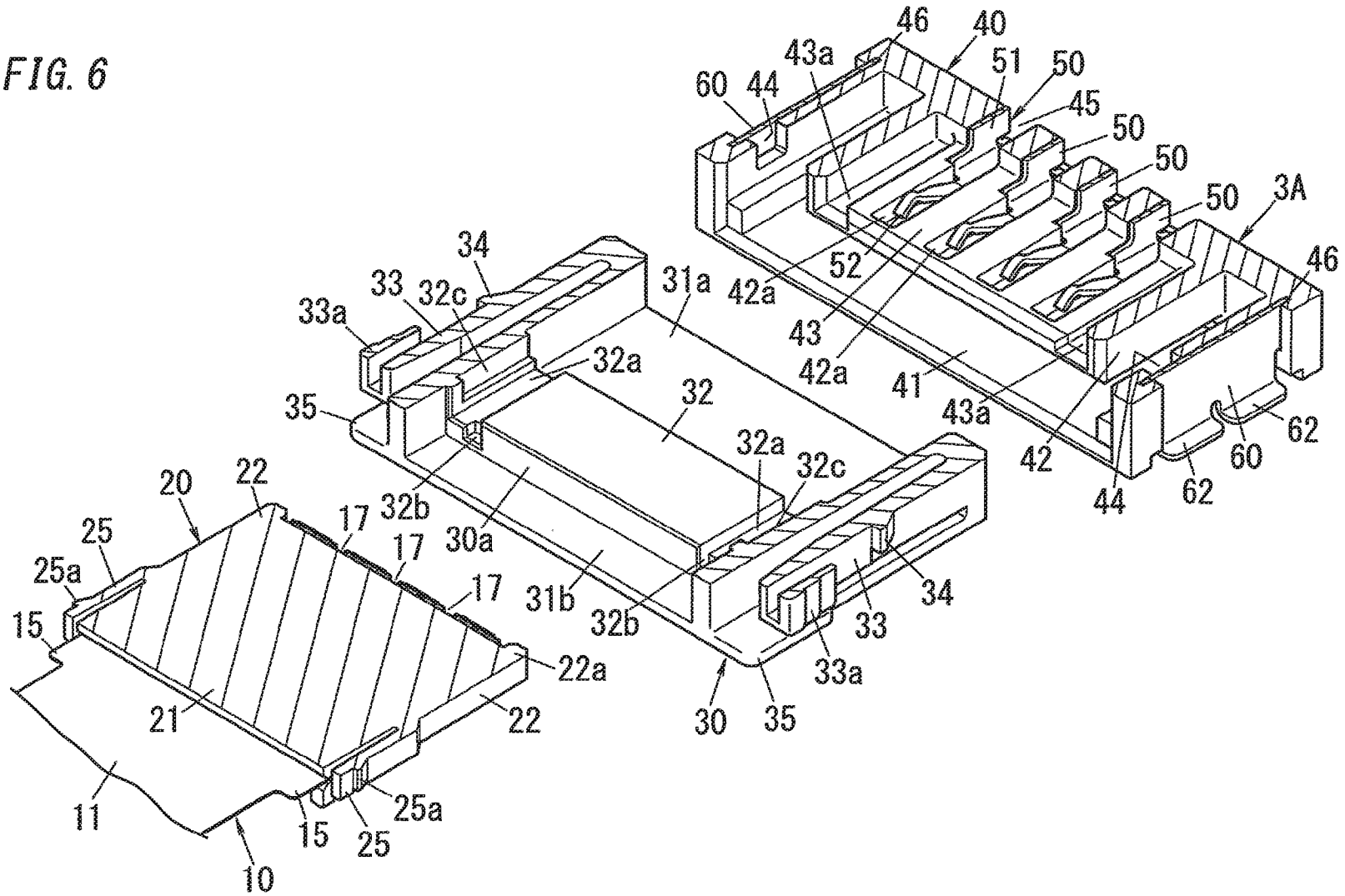
FIG. 6 is an exploded perspective sectional view of the connector device of the present embodiment from the top side.

The following description referring to the drawings is made to a cable holding member, an electrical connection device including this cable holding member, and a connector device including this electrical connection device and a receptacle connector, which are of embodiments of the present invention.

The connector device 1 of the present embodiment is constituted by an electrical connection device 2 including a cable holding member 20 for holding a flat cable 10, and a receptacle connector to be removably connected to the electrical connection device 2. The receptacle connector may be exemplified by a receptacle connector 3A for substrate connection (of an SMD (Surface Mount Device) type) which is to be mounted on a printed wiring board by surface mounting, and a receptacle connector 3B for cable connection which is to be connected to an electric cable. Initially, the connector device 1 including the receptacle connector 3A for substrate connection is described with reference to FIG. 1 to FIG. 10. Unless otherwise noted, the connector device 1 including the receptacle connector 3A for substrate connection is described on the basis of directions designated by arrows shown in FIG. 1, but directions of the connector device 1 in use are not limited to the above directions.

Figure 8:
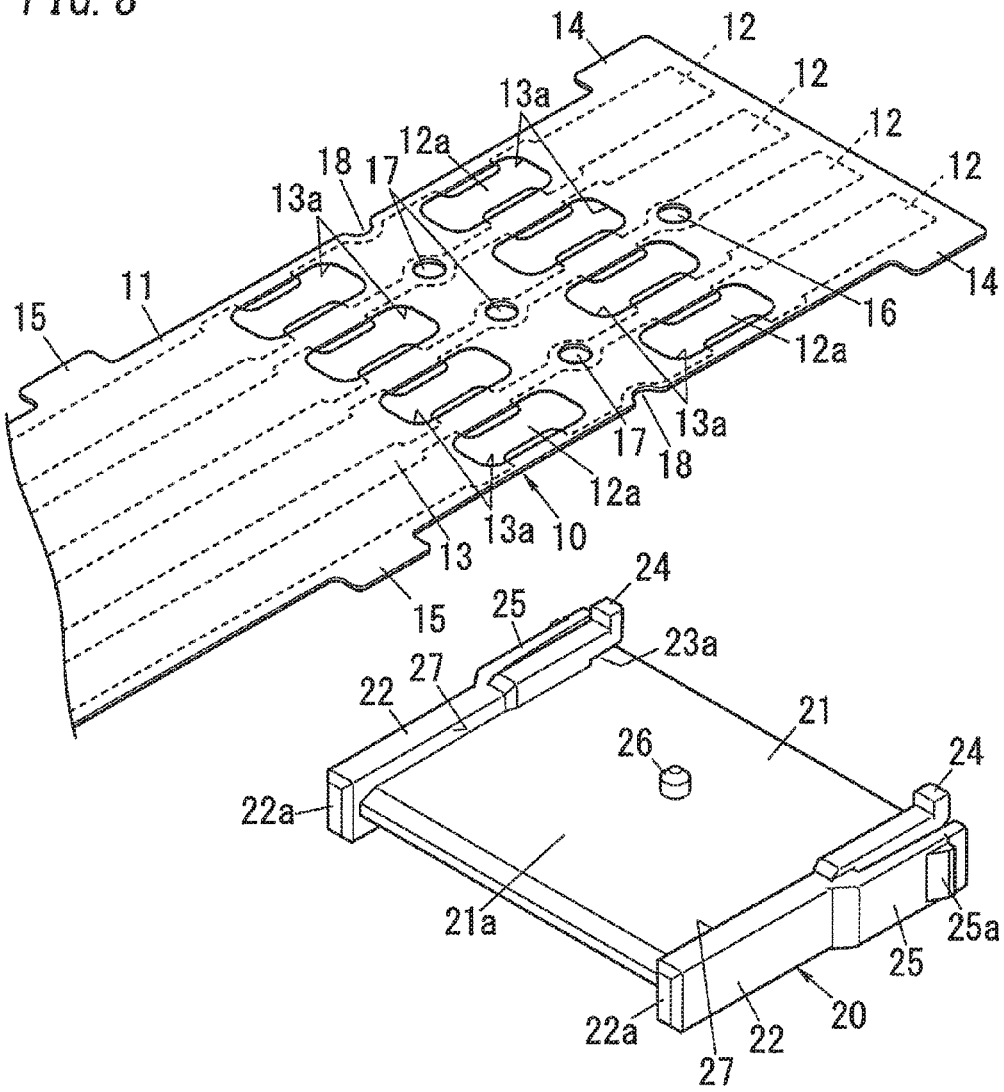
FIG. 8 is an explanatory view illustrating how to support a flat cable on the cable holding member of the present embodiment.
Figure 9:
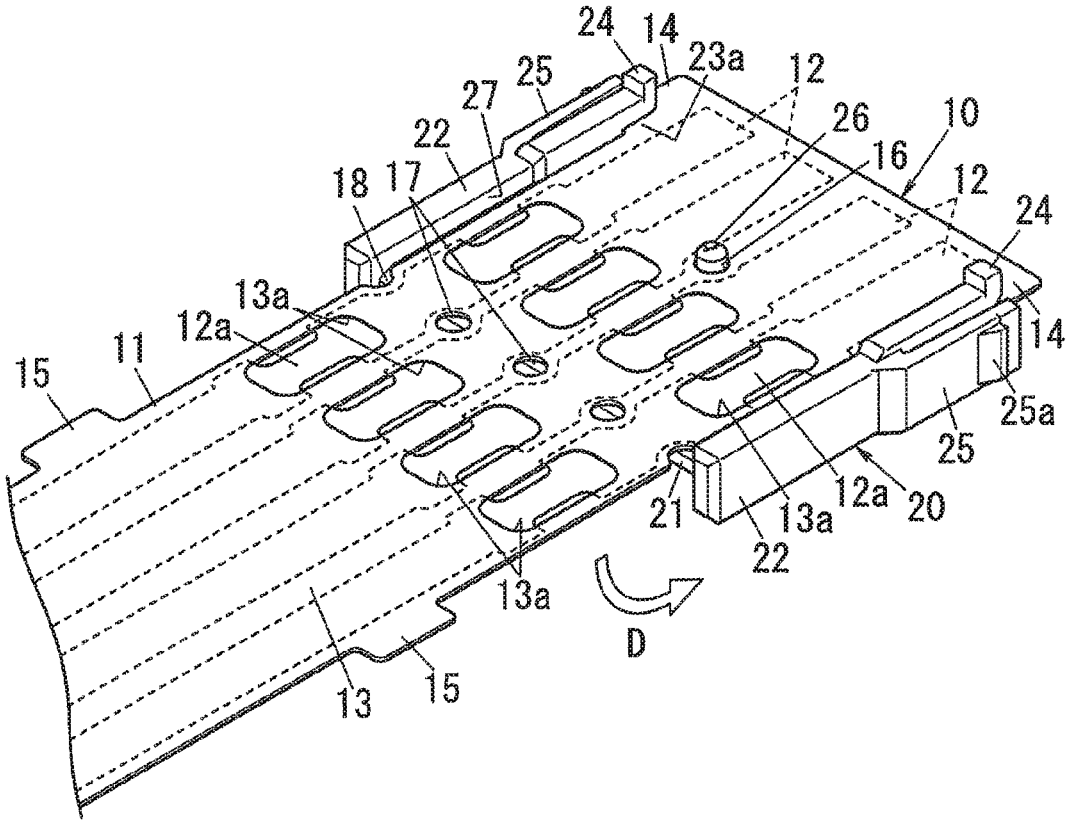
FIG. 9 is an explanatory view illustrating how to support the flat cable on the cable holding member of the present embodiment.
Figure 10:
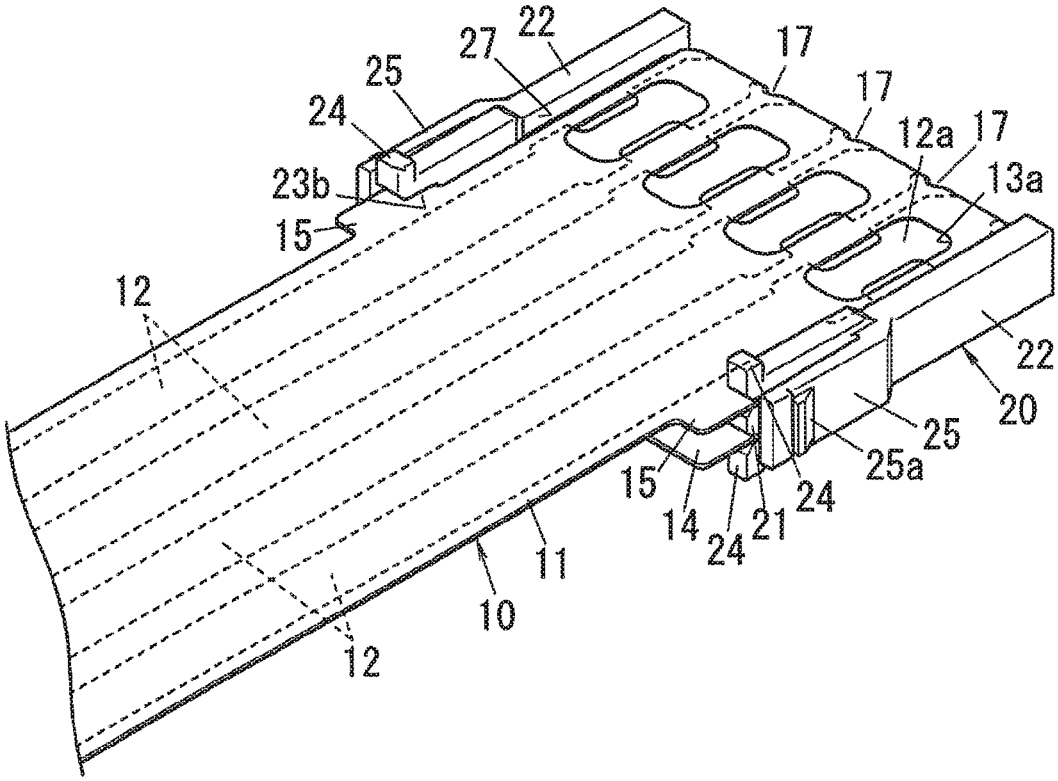
FIG. 10 is an explanatory view illustrating how to support the flat cable on the cable holding member of the present embodiment.

As shown in FIG. 8 to FIG. 10, the flat cable 10 is made of a flexible printed circuit board (FPC: Flexible Printed Circuits). The flat cable 10 includes a substrate 11 which is formed in an elongated film shape and is made of an insulating resin material. Note that, the flat cable 10 is not limited to a flexible printed circuit board, but may be a flexible flat cable.

Multiple (four in the present embodiment) electric conductors 12 (electrically conductive members) which form individual electric conducting paths are formed on a front surface of the substrate 11. Each of the multiple electric conductors 12 is formed in a strip shape extending along a length direction of the substrate 11 by patterning a thin film of an electrically conductive material formed on the front surface of the substrate 11. The multiple electric conductors 12 are arranged at almost the same intervals in a width direction of the substrate 11.

A reinforcing part 13 formed in a film shape and made of insulating synthetic resin such as polyimide resin is individually attached to the front surface and a rear surface of the substrate 11. The electric conductor 12 is covered with this reinforcing part 13. The reinforcing part 13 is provided with multiple openings 13*a* for exposing parts of the electric conductor 12 to be in contact with terminals 50 of the receptacle connector 3A. The parts of the electric conductor 12 exposed via the openings 13*a* serve as electrically conductive parts 12*a* to be electrically connected to the terminal 50. Note that, with regard to the electric conductor 12, plating layers of gold may be formed on the electrically conductive parts 12*a* exposed via the openings 13*a*. This may lead to an increase in reliability of electrical contact.

There are first protrusions 14 provided to one end of the substrate 11 in a length direction of the substrate 11 so as to protrude outward in a width direction (left and right direction in FIG. 1) of the substrate 11. Further, first protrusions 15 are provided to left and right side edges of the substrate 11 to protrude outward in the width direction so as to overlap the first protrusions 14 in the upward and downward direction when an end of the substrate 11 is folded in order to attach the flat cable 10 to the cable holding member 20. Note that, in the length direction of the substrate 11, a dimension of each first protrusion 14 is set to be equal to a dimension of each first protrusion 15.

There is a hole 16 provided to the substrate 11. The hole 16 receives a second protrusion 26 provided to the cable holding member 20 when the flat cable 10 is supported on the cable holding member 20.

There are three holes 17 provided to part of the substrate 11 intermediate between the first protrusion 14 and the first protrusion 15 in the length direction of the substrate 11. The holes 17 penetrate the substrate 11 and are arranged in the width direction of the substrate 11. There are cut-outs 18 provided to opposite side edges in the length direction of the substrate 11. The cut-outs 18 are on a straight line on which the three holes 17 are arranged in the width direction of the substrate 11. In the length direction of the substrate 11, part provided with the holes 17 and the cut-outs 18 is more flexible than the other part, and thus the substrate 11 can be easily bent at this part.

As shown in FIG. 8 to FIG. 10, the cable holding member 20 is a molded product of an insulating synthetic resin, and includes a supporting part 21 in a rectangular plate shape, and a pair of wall parts 22 which are provided to opposite left and right side edges of the supporting part 21 and formed integrally therewith. The supporting part 21 is formed into a rectangular plate shape. The supporting part 21 has an upper face and a lower face which constitute a supporting face 21*a* supporting the flat cable 10 in a folded state. Each wall part 22 has a shape protruding upward and downward from the supporting part 21, and each wall part 22 is connected to the supporting part 21 at an intermediate part in the upward and downward direction. There are a first groove 23*a* and a second groove 23*b* provided to an internal face 27 of each of the left and right wall parts 22. The first groove 23*a* is for receiving the first protrusion 14 and is on an upper side of the supporting part 21, and the second groove 23*b* is for receiving the first protrusion 15 and is on a lower side of the supporting part 21. The first groove 23*a* and the second groove 23*b* each have an open front end. The first groove 23*a* is shorter in the forward and rearward direction than the first protrusion 14. Similarly, the second groove 23*b* is shorter in the forward and rearward direction than the first protrusion 15. In the present embodiment, the first groove 23*a* is provided to the internal face 27 of the wall part 22, but the first groove 23*a* may be provided to part other than the internal face 27 of the wall part 22 depending on the shape of the corresponding first protrusion 14. For example, when the first protrusion 14 has an L shape, and a groove for partially receiving the wall part 22 is provided between the side edge of the substrate 11 and the first protrusion 14, the first groove 23*a* for receiving the first protrusion 14 may be provided to a front end face or an external face of the wall part 22. Similarly, in the present embodiment, the second groove 23*b* is provided to the internal face 27 of the wall part 22, but the second groove 23*b* may be provided to part other than the internal face 27 of the wall part 22 (e.g., a front end face or an external face of the wall part 22) depending on the shape of the corresponding first protrusion 15.

Further, opening dimensions of the first groove 23*a* and the second groove 23*b* in a thickness direction of the flat cable 10 supported on the supporting part 21 are equal to a thickness of the flat cable 10. The first protrusion 14 of the flat cable 10 can be inserted into the first groove 23*a*. The first protrusion 15 of the flat cable 10 can be inserted into the second groove 23*b*. Note that, the opening dimensions of the first groove 23*a* and the second groove 23*b* are equal to the thickness of the flat cable 10 but this does not require that the opening dimensions are exactly equal to the thickness, and differences between dimensions due to dimension error occurring in manufacture may be acceptable to an extent that there is no problem with functions.

Further, there are protrusions 24 provided to each of the left and right wall parts 22. The protrusions 24 protrude upward and downward from a rear end of a corresponding one of the wall parts 22. Further, there is a slit provided to each of the left and right wall parts 22 to form a movable piece 25. The slit has an open rear end, and the movable piece 25 is flexible in the left and right direction. There is a claw 25*a* provided to each of the movable pieces 25, and the claw 25*a* protrudes outward in the left and right direction. The claw 25*a* is tapered so as to protrude outward toward its rear end.

Further, there is the second protrusion 26 provided to an upper face of the supporting part 21. The second protrusion 26 is fitted into the hole 16 provided to the substrate 11 when the substrate 11 is supported on the supporting part 21.

Hereinafter, how to attach the flat cable 10 to the cable holding member 20 is described with reference to FIG. 8 to FIG. 10.

As shown in FIG. 8, in assembly, a worker aligns a first end of the flat cable 10 in the length direction to the position of the supporting part 21 of the cable holding member 20 and moves the first end of the flat cable 10 toward the supporting part 21 from the above. The worker deforms the first end of the flat cable 10 and then inserts the left and right first protrusions 14 into the corresponding first grooves 23*a*, and inserts the second protrusion 26 into the hole 16, and thereby the first end of the flat cable 10 is held by the cable holding member 20 (see FIG. 9). Subsequently, the worker bends a second end of the flat cable 10 in the length direction toward a direction of an arrow D in FIG. 9, and deforms bent part of the flat cable 10 and then inserts the left and right first protrusions 15 into the corresponding second grooves 23*b* (see FIG. 10). By doing so, the first protrusions 14 are inserted into the first groove 23*a*, and the first protrusions 15 are inserted into the second grooves 23*b*, and further the second protrusion 26 is inserted into the hole 16, and thereby the flat cable 10 is held by the cable holding member 20.

When the second end of the flat cable 10 whose first end in the length direction is supported on the supporting part 21 is pulled out, resultant pull-out force can be received by the first grooves 23*a* receiving and holding the first protrusions 14. Therefore, resistance to pull-out of the flat cable 10 supported on the supporting part 21 can be improved, and hence even if pull-out force acts on the flat cable 10, displacement of the flat cable 10 hardly occur, and reliability of electrical connection between the electric conductors 12 and the terminals 50 can be improved.

Further, in the present embodiment, the second grooves 23*b* receiving and holding the first protrusions 15 are provided to the opposite side from the first grooves 23*a*. Therefore, the pull-out force acting on the flat cable 10 can be received by the first grooves 23*a* and the second grooves 23*b*. In contrast to such force is received by only the first grooves 23*a*, resistance to pull-out of the flat cable 10 supported on the supporting part 21 can be improved.

Further, in the present embodiment, the second protrusion 26 of the supporting part 21 is inserted into the hole 16 of the flat cable 10. Therefore, the pull-out force acting on the flat cable 10 can be received by the second protrusion 26, too. In contrast to such force is received by only the first grooves 23*a* and the second grooves 23*b*, resistance to pull-out of the flat cable supported on the supporting part 21 can be improved.

Further, the holes 17 and the cut-outs 18 are provided to part of the substrate 11 to be bent. Provision of the holes 17 and the cut-outs 18 leads to an increase in flexibility of this part, and therefore bending the substrate 11 can be facilitated.

Hereinafter, the electrical connection device 2 including the cable holding member 20 is described with reference to FIG. 1 to FIG. 6.

The electrical connection device 2 includes the cable holding member 20 and a first housing 30 for holding the cable holding member 20 in a state of supporting the flat cable 10.

The first housing 30 is a molded product of an insulating synthetic resin, and is in a hollow cuboidal shape which is longer in the left and right direction than in the upward and downward direction and has opposite open ends in the forward and rearward direction. An inside space of the first housing 30 is separated in two front and rear spaces with an internal wall 30*a*. An insertion opening 31*a* which is an opening in a front face of the first housing 30 and an insertion opening 31*b* which is an opening in a rear face of the first housing 30 are interconnected by a fitting hole 32 which is in a slit shape and penetrates the internal wall 30*a*. The fitting hole 32 receives the cable holding member 20 supporting the flat cable 10. There are wide opening parts 32*a* provided to left and right sides of the fitting hole 32, and the wide opening parts 32*a* are longer in a dimension in the upward and downward direction than central part of the fitting hole 32 in the left and right direction. The wide opening parts 32*a* receive the wall parts 22 of the cable holding member 20. In the inside space of the first housing 30, there are grooves 32*b* provided to a periphery of an opening on the rear side (a side directed to the cable holding member 20) of the wide opening part 32*a*, and the grooves 32*b* receive the protrusions 24 provided to the wall parts 22. Further, there are grooves 32*c* provided to an inside wall of the first housing 30, and the grooves 32*c* receive and hold the claws 25*a* of the movable pieces 25 when the wall part 22 is inserted into the wide opening part 32*a* of the fitting hole 32.

There are movable pieces 33 provided to left and right side parts of the first housing 30, and each movable piece 33 is connected to a body part of the first housing 30 at its front end. The movable piece 33 has a rear end movable in the left and right direction, and the rear end of the movable piece 33 is provided with a manipulation part 33*a* for allowing pressing by hand protruding therefrom outward in the left and right direction (toward the opposite side of the first housing 30 from the center in the left and right direction). Further, there is a claw 34 provided to a center of an external face of the movable piece 33 in the forward and rearward direction, and the claw 34 protrudes outward in the left and right direction. The claw 34 is tapered so as to protrude outward toward its rear end. Note that, there are cover parts 35 extending from left and right side edges of the rear part of the first housing 30 so as to overlap the corresponding movable pieces 33 in the upward and downward direction. The cover part 35 protects the movable piece 33 so as to prevent unintentional press of the movable piece 33.

When the cable holding member 20 supporting the flat cable 10 is inserted into the insertion opening 31*b* of the first housing 30 from back, the supporting part 21 is inserted into the fitting hole 32 and the wall parts 22 are inserted into the left and right wide opening parts 32*a*. The supporting part 21 and the left and right wall parts 22 are inserted into the fitting hole 32, and accordingly the position of the cable holding member 20 is determined in the left and right direction and the upward and downward direction. Additionally, when the wall parts 22 are inserted into the wide opening parts 32*a*, the claws 25*a* are in contact with the internal wall of the first housing 30, and thereby the movable pieces 25 are displaced inward. When the cable holding member 20 is inserted to a predetermined position, the protrusions 24 are fitted into the grooves 32*b*, and thereby forward movement of the cable holding member 20 is limited. Further, when the cable holding member 20 is inserted to the predetermined position, the claws 25*a* comes into the grooves 32*c*, and thereby the movable pieces 25 move outward, and this lead to engagement of the claws 25*a* with ends of the grooves 32*c*. Accordingly, rearward movement of the cable holding member 20 is limited. As a result, the cable holding member 20 supporting the flat cable 10 is held while attached to the first housing 30, the cable holding member 20 supporting the flat cable 10 and the first housing 30 constitute the electrical connection device 2. While the cable holding member 20 is attached to the first housing 30, front part of the cable holding member 20 protrudes forward via the fitting hole 32, and is inside the insertion opening 31*a* in the front face of the first housing 30. Note that, the front end of the cable holding member 20 has such a shape that the front end of the cable holding member 20 protrudes outward from the front end of the first housing 30. The electrical connection device 2 functions as a plug connector to be removably connected to the receptacle connector 3A.

Hereinafter, the receptacle connector 3A allowing removable connection of the electrical connection device 2 is described with reference to FIG. 1 to FIG. 7B.

The receptacle connector 3A includes the multiple terminals 50 to be electrically connected to the multiple electrically conductive parts 12*a* of the flat cable 10, and a second housing 40 for supporting the terminals 50.

The second housing 40 is a molded product of an insulating synthetic resin, and is in a hollow cuboidal shape with an open rear face defining an insertion opening 41 allowing insertion of the electrical connection device 2. There is a hollow cuboidal part 42 protruding rearward from the internal face of a front wall of the second housing 40, and the hollow cuboidal part 42 is to be fitted into an insertion opening 31*a* in the front face of the first housing 30. There is a fitting hole 43 formed in an end face (rear face) of the hollow cuboidal part 42. The fitting hole 43 is in a slit shape to receive front part of the cable holding member 20. There are wide opening parts 43*a* provided to left and right sides of the fitting hole 43, and the wide opening parts 43*a* are longer in a dimension in the upward and downward direction than central part of the fitting hole 43 in the left and right direction. The wide opening parts 43*a* receive the wall parts 22. Further, there are holes 44 respectively provided to a left side wall and a right side wall of the second housing 40, and the holes 44 receive and hold the claws 34 of the electrical connection device 2.

The hollow cuboidal part 42 supports the multiple terminals 50 individually corresponding to the multiple electric conductors 12 of the flat cable 10 supported on the cable holding member 20.

Figure 7A:
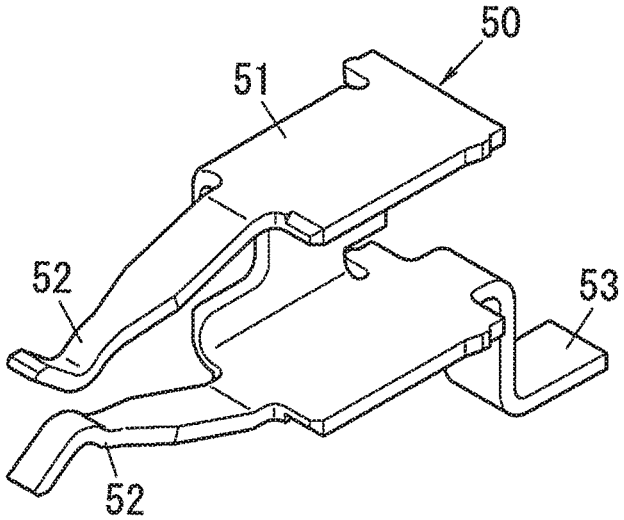
FIG. 7A and FIG. 7B are perspective views of appearance of a terminal of the receptacle connector used in the connector device of the present embodiment.
Figure 7B:
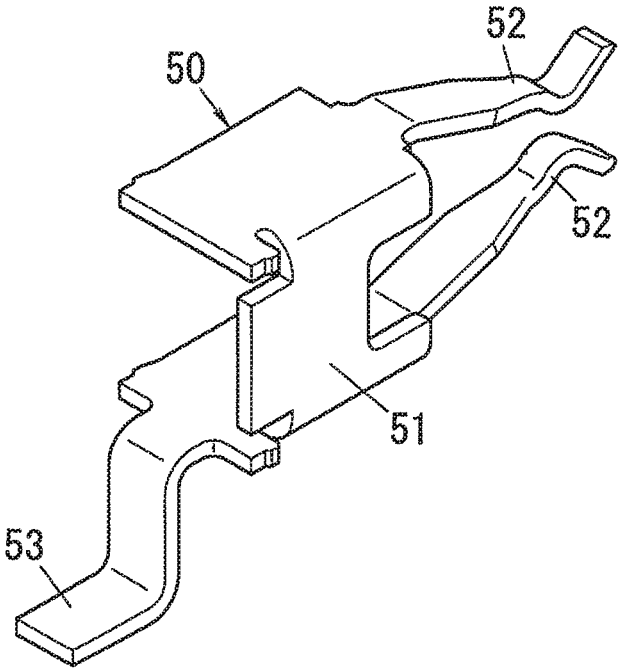

As shown in FIG. 7A and FIG. 7B, the terminal 50 includes a fixed part 51 and a pair of contacts 52. Further, the receptacle connector 3A is of a surface-mounted type, and therefore the terminal 50 includes a soldered piece 53. The terminal 50 is formed of a metal plate by perforating and bending, and includes the fixed part 51, the pair of contacts 52, and the soldered piece 53 which are formed integrally.

The fixed part 51 is formed by bending a metal plate, and thus a shape of the fixed part 51 is a C shape when viewed from top. The fixed part 51 is fitted into a hole 45 formed in the front wall of the second housing 40.

The contacts 52 protrude rearward from rear ends of an upper piece and a lower piece of the fixed part 51 individually. The pair of contacts 52 are arranged on the upper and lower sides of the fitting hole 43 so that the fitting hole 43 is present between the pair. The contacts 52 are formed by bending so as to incline so as to be close to each other toward their rear ends. When the cable holding member 20 is inserted into the fitting hole 43, the pair of contacts 52 come into elastic contact with the electric conductor 12 of the flat cable 10 from above and below. Note that, a rear end of each of the pair of contacts 52 is bent to have a V shape when viewed from side. This may lead to easy insertion of the cable holding member 20 into between the pair of contacts 52.

A front end of the lower piece of the fixed part 51 is bent downward, and a lower part thereof is bent forward, and thereby the soldered piece 53 is formed. The soldered piece 53 is almost parallel to a lower face of the second housing 40, and a lower face of the soldered piece 53 is positioned slightly below the lower face of the second housing 40. Each of the multiple soldered pieces 53 is soldered to a land formed on a surface of a printed wiring board (not shown), and thereby the terminals 50 of the receptacle connector 3A are electrically connected to a circuit of the printed wiring board.

These terminals 50 are fixed to the receptacle connector 3A as follows. The worker inserts the terminal 50 into the hole 45 formed in the front wall of the second housing 40, with the contact 52 facing the hole 45. Then, the fixed part 51 is engaged with the internal wall of the hole 45, and thereby the terminal 50 is fixed to the second housing 40. There are grooves 42*a* formed in an upper side face and a lower side face facing the fitting hole 43 of the hollow cuboidal part 42, and the contacts 52 are situated in the grooves 42*a* one-by-one. When the fixed part 51 is fixed to the second housing 40, each contact 52 is positioned inside a corresponding one of the grooves 42*a*, the pair of contacts 52 of the terminal 50 face each other in the upward and downward direction with the fitting hole 43 in-between. Further, when the fixed part 51 is fixed to the second housing 40, the soldered piece 53 is parallel to the lower face of the second housing 40, and is slightly below the lower face of the second housing 40.

Further, there are holding fixtures 60 provided to a left side face and a right side face of the second housing 40 one-by-one. The holding fixtures 60 are used to fix the second housing 40 to the printed wiring board. The holding fixture 60 is formed of a metal plate by bending, and includes a main part 61 in a rectangular plate shape, fixed pieces 62 protruding in a direction perpendicular to the main part 61 from a lower side edge of the main part 61, and engaging pieces 63 protruding in an opposite direction to the fixed pieces 62 from an upper side edge of the main part 61, which are formed integrally. There are grooves 46 formed in left and right side walls of the second housing 40, and the grooves 46 receive left and right side edges of the main part 61, respectively. The grooves 46 extend from the upper face of the second housing 40 to a predetermined position below the upper face. When the main part 61 is inserted into the grooves 46 from above with the fixed pieces 62 being directed outward, the left and right side edges of the main part 61 are pressed into the grooves 46 and thereby the holding fixture 60 is fixed to the second housing 40. When the main part 61 is inserted to the ends of the grooves 46, the engaging pieces 63 are inserted into recesses 40*a* provided to the upper face of the second housing 40, and then a lower face of the fixed piece 62 is protruded slightly downward from the lower face of the second housing 40, and is positioned at the same height as the soldered piece 53. The holding fixture 60 is soldered to a land for fixing formed on a surface of a printed wiring board (not shown), and is used for mechanically fixing the second housing 40 to the printed wiring board.

The connector device 1 of the present embodiment has the aforementioned configuration, and the electrical connection device 2 is attached to or detached from the receptacle connector 3A in the following manners.

When the first housing 30 of the electrical connection device 2 is inserted into the insertion opening 41 of the second housing 40 of the receptacle connector 3A, the hollow cuboidal part 42 of the second housing 40 is inserted into the insertion opening 31*a* in the front of the first housing 30. In this regard, the front part of the cable holding member 20 is inserted into the fitting hole 43 of the hollow cuboidal part 42, and the flat cable 10 supported on the upper and lower faces of the supporting part 21 is inserted between the pair of contacts 52. Since the electrically conductive parts 12*a* are provided to parts of the flat cable 10 to be situated on the upper face and the lower face of the supporting part 21, the pair of contacts 52 are in contact with the electrically conductive parts 12*a* from above and below, and thereby each electric conductor 12 of the flat cable 10 is electrically connected to a corresponding one of the terminals 50. Further, when the first housing 30 is inserted into the insertion opening 41 of the second housing 40 to a predetermined position, the claws 34 of the first housing 30 are fitted into the holes 44 of the second housing 40, and thereby connection between the electrical connection device 2 and the receptacle connector 3A is maintained.

To detach the electrical connection device 2 from the receptacle connector 3A, the worker touches the manipulation parts 33*a* provided to the first housing 30 and deform the left and right movable pieces 33 inward. Thereby, the claws 34 move outside the holes 44, and then connection between the claws 34 and the holes 44 are canceled. In this state, the worker can detach the first housing 30 from the second housing 40 by pulling the first housing 30 rearward. Apparently, it is possible to easily detach the electrical connection device 2 from the receptacle connector 3A.

As described above, the cable holding member 20 of the present embodiment includes the supporting part 21 and the pair of wall parts 22 to hold the flat cable 10 in a strip shape. The flat cable 10 includes the substrate 11 where the electric conductor 12 (multiple electrically conductive members) are arranged side by side in the width direction of the flat cable 10, and the first protrusions 14 protruding outward in the width direction of the flat cable 10 from the side edges of the substrate 11 in the width direction of the flat cable 10. The supporting part 21 includes the supporting face 21*a* for supporting the flat cable 10 in the folded state. The pair of wall parts 22 are provided to the supporting part 21 so as to be on the opposite sides of the flat cable 10 in the width direction of the flat cable 10 supported on the supporting part 21. The at least one groove (the first groove 23*a*) for receiving the first protrusion 14 of the flat cable 10 is provided to each of the pair of wall parts 22. According to the cable holding member 20, the flat cable 10 is supported on the supporting part 21 with the first protrusions 14 being in the grooves (the first groove 23*a*) provided individually to the pair of wall parts 22. Therefore, pull-out force acting on the flat cable 10 can be received by the groove (the first groove 23*a*) to receive the first protrusion 14, and therefore it is possible to realize the cable holding member 20 with improved resistance to pull-out.

Further, in the cable holding member 20 of the present embodiment, the second protrusion 26 to be fitted into the hole 16 provided to the flat cable 10 is provided to the supporting part 21. Accordingly, in a process of supporting the flat cable 10 on the supporting part 21, the second protrusion 26 can be fitted into the hole 16, and thereby the flat cable 10 can be tentatively supported on the supporting part 21. Therefore, it is possible to facilitate the process of supporting the flat cable 10 on the supporting part 21. Additionally, the second protrusion 26 is provided to only one of faces of the supporting part 21, and therefore it is possible to determine which one of the faces of the supporting part 21 is a front face or a rear face, based on whether the second protrusion 26 is present. Note that, plane shapes of the second protrusion 26 and the hole 16 are circular shapes. However, the plane shapes of the second protrusion 26 and the hole 16 are not limited to such circular shapes but may be oval shapes or polygonal shapes such as rectangular or square shapes. The number of second protrusions 26 and the number of holes 16 may be one or more.

Further, in the cable holding member 20 of the present embodiment, the groove (the first groove 23*a*) provided to each of the pair of wall parts 22 and the second protrusion 26 are provided in different positions in the length direction of the flat cable 10 which is perpendicular to the width direction of the flat cable 10. Therefore, the two grooves (the first grooves 23*a*) provided to the wall parts 22 on the opposite sides of the flat cable 10 and the second protrusion 26 are positioned in vertices of a triangle, and thus displacement of the flat cable 10 hardly occurs in the length direction of the flat cable 10.

Further, in the cable holding member 20 of the present embodiment, the at least one groove provided to the pair of wall parts 22 includes the first groove 23*a* and the second groove 23*b*. The first groove 23*a* is provided to the internal face 27 of each of the pair of wall parts 22 on the front side of the supporting part 21. The second groove 23*b* is provided to the internal face 27 of each of the pair of wall parts 22 on the rear side of the supporting part 21. With regard to each of the pair of wall parts 22, the first groove 23*a* and the second groove 23*b* are provided respectively on the front side and the rear side of the supporting part 21 to be in a same position when viewed in the thickness direction of the flat cable 10 supported on the supporting part 21.

The first protrusion 14 of the flat cable 10 is inserted into the first groove 23*a* on the front side of the supporting part 21, and the first protrusion 15 of the flat cable 10 is inserted into the second groove 23*b* on the rear side of the supporting part 21. Accordingly, the flat cable 10 can be supported on the supporting part 21 without being loosened. Further, the first groove 23*a* on the front side of the supporting part 21 and the second groove 23*b* on the rear side of the supporting part 21 are in the same position when viewed in the forward and rearward direction of the supporting part 21. Accordingly, the flat cable 10 can be bent at intermediate part between the first protrusion 14 to be inserted into the first groove 23*a* and the first protrusion 15 to be inserted into the second groove 23*b*.

Further, in the cable holding member 20 of the present embodiment, the first groove 23*a* is shaped to receive the first protrusion 14 in the width direction of the flat cable 10. Accordingly, it is possible to insert the first protrusion 14 into the first groove 23*a* by deforming the flat cable 10. Further, the second groove 23*b* also is shaped to receive the first protrusion 15 in the width direction of the flat cable 10. Accordingly, it is possible to insert the first protrusion 15 into the second groove 23*b* by deforming the flat cable 10.

Further, in the cable holding member 20 of the present embodiment, an opening dimension of each of the first groove 23*a* and the second groove 23*b* in the thickness direction of the flat cable 10 supported on the supporting part 21 is equal to the thickness of the flat cable 10. Accordingly, the first protrusion 14 of the flat cable 10 can be held by the first groove 23*a* without chatter. Additionally, the first protrusion 15 of the flat cable 10 can be held by the second groove 23*b* without chatter.

Further, in the cable holding member 20 of the present embodiment, the pair of guiding parts (protruded portions 22*a*) are provided to the pair of wall parts 22 to facilitate insertion of the cable holding member 20 into the fitting hole 32 which is defined by one of the opposite open ends of the first housing 30 with a hollow cylindrical or prism shape. The pair of guiding parts for guiding insertion of the cable holding member 20 into the fitting hole 32 are provided to ends of the pair of wall parts 22 in an insertion direction in which the cable holding member 20 is inserted into the fitting hole 32. The end of the wall part 22 in the insertion direction protrudes more forward in the insertion direction than the supporting part 21 does, and thus the protruded portion 22*a* serves as the guiding part. Therefore, the protruded portion 22*a* provided to the end of the wall part 22 is inserted into the wide opening part 32*a* first, and the protruded portion 22*a* is positioned inside the wide opening part 32*a*. Consequently, the supporting part 21 is guided to the fitting hole 32, and thus inserting the supporting part 21 into the fitting hole 32 can be facilitated.

Although the aforementioned cable holding member 20 includes the pair of wall parts 22, the cable holding member according to the present embodiment may include a single wall part positioned one side of the width direction of the flat cable. In summary, the cable holding member according to the present embodiment may include at least one wall part provided to the supporting part so as to be on a side of the flat cable in the width direction of the flat cable supported on the supporting part.

Further, the electrical connection device 2 of the present embodiment includes the aforementioned cable holding member 20 and the first housing 30 with a hollow cylindrical or prism shape with opposite open ends. The first housing 30 holds the cable holding member 20 which is inserted into the first housing 30 via the first one of the open ends while the flat cable 10 is supported thereon. The first housing 30 makes, when the receptacle connector 3A including the second housing 40 supporting the multiple terminals 50 is inserted into the first housing 30 via the second one of the open ends with the multiple terminals 50 being directed to the first housing 30, electrical connection between the multiple terminals 50 and a corresponding one of the multiple electrically conductive members (the multiple electric conductors 12).

Accordingly, it is possible to realize the electrical connection device 2 including the cable holding member 20 with improved resistance to pull-out of the flat cable 10.

Figure 11:
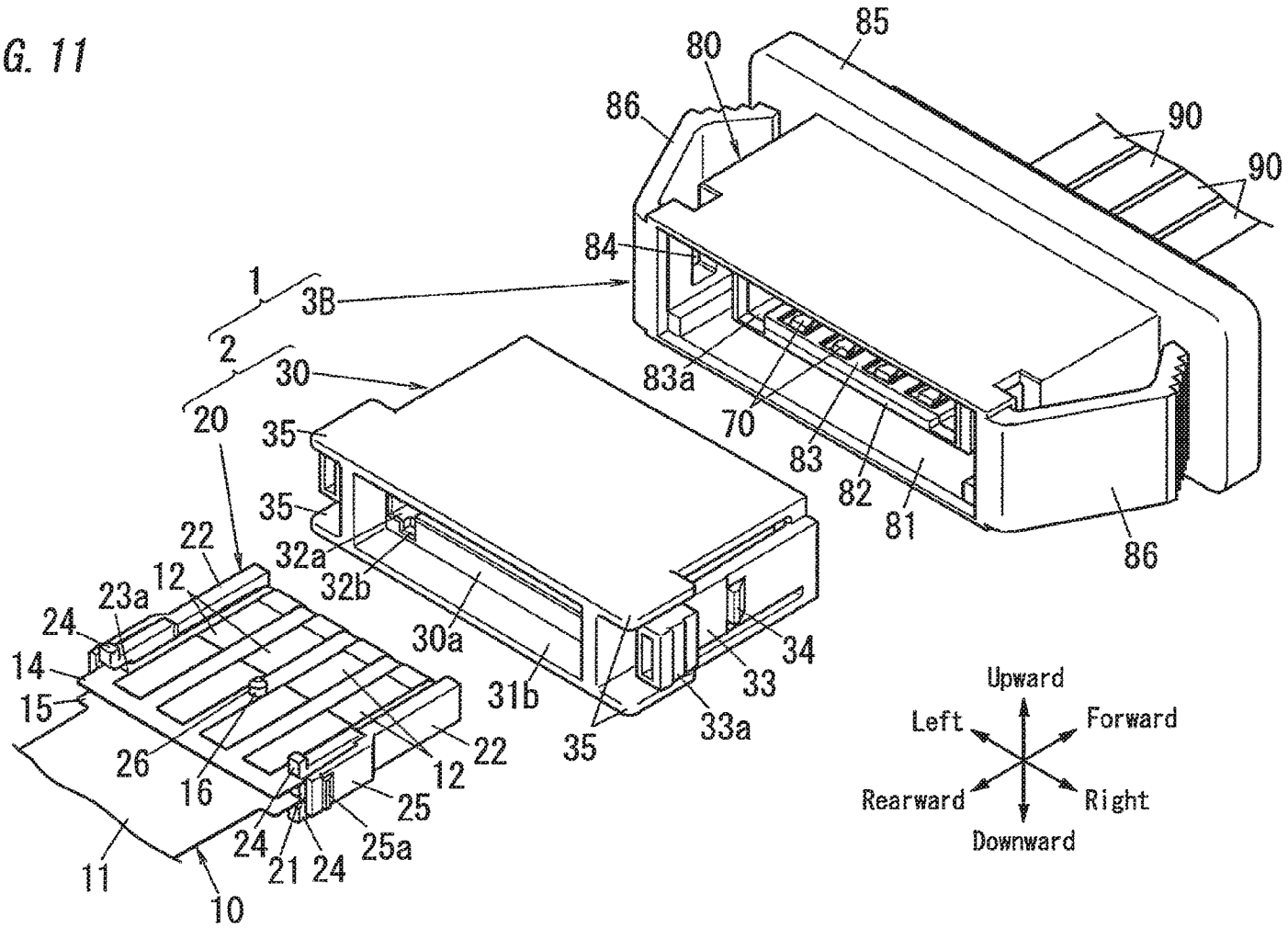
FIG. 11 is an exploded perspective view of a connector device including the electrical connection device of the present embodiment and a receptacle connector of a cable connecting type.

Note that, the connector device 1 described with reference to FIG. 1 to FIG. 7B includes the electrical connection device 2 and the receptacle connector 3A for substrate connection, but may include a receptacle connector for cable connection as an alternative to the receptacle connector 3A for substrate connection. Hereinafter, the connector device 1 including the electrical connection device 2 and the receptacle connector 3B for cable connection is described with reference to FIG. 11 to FIG. 17B. Unless otherwise noted, the connector device 1 including the receptacle connector 3B for cable connection is described on the basis of directions represented by arrows shown in FIG. 11, but the directions of the connector device 1 in use are not limited to the above directions.

The electrical connection device 2 has the same configuration as described with reference to FIG. 1 to FIG. 10, and explanations thereof are omitted.

The receptacle connector 3B for cable connection includes multiple terminals 70 to be electrically and individually connected to multiple (four, in the present embodiment) electric cables 90, and a second housing 80 for supporting the multiple terminals 70.

The second housing 80 is a molded product of an insulating synthetic resin, and is in a hollow cuboidal shape with an open rear face defining an insertion opening 81 allowing insertion of the electrical connection device 2. There is a hollow cuboidal part 82 protruding rearward from the internal face of a front wall of the second housing 80, and the hollow cuboidal part 82 is to be fitted into an insertion opening 31*a* in the front face of the first housing 30. There is a fitting hole 83 formed in an end face (rear face) of the hollow cuboidal part 82. The fitting hole 83 is in a slit shape to receive front part of the cable holding member 20. There are wide opening parts 83*a* provided to left and right sides of the fitting hole 83, and the wide opening parts 83*a* are longer in a dimension in the upward and downward direction than central part of the fitting hole 83 in the left and right direction. The wide opening parts 83*a* receive the wall parts 22 of the cable holding member 20. Further, there are holes 84 respectively provided to a left side wall and a right side wall of the second housing 80, and the holes 84 receive and hold the claws 34 of the electrical connection device 2.

Figure 12A:
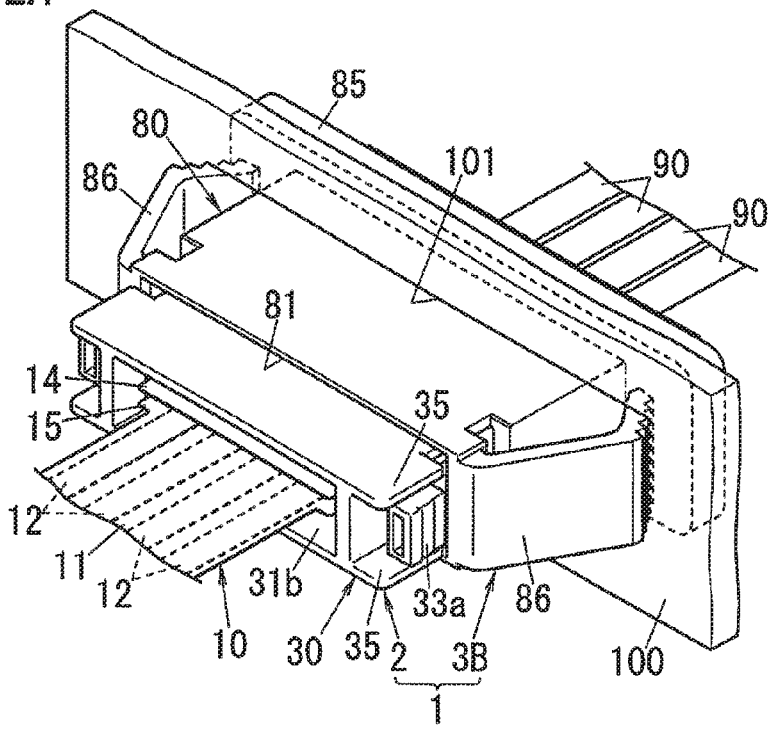
FIG. 12A is a perspective view of the connector device of the present embodiment wherein the electrical connection device and the receptacle connector are connected.
Figure 12B:
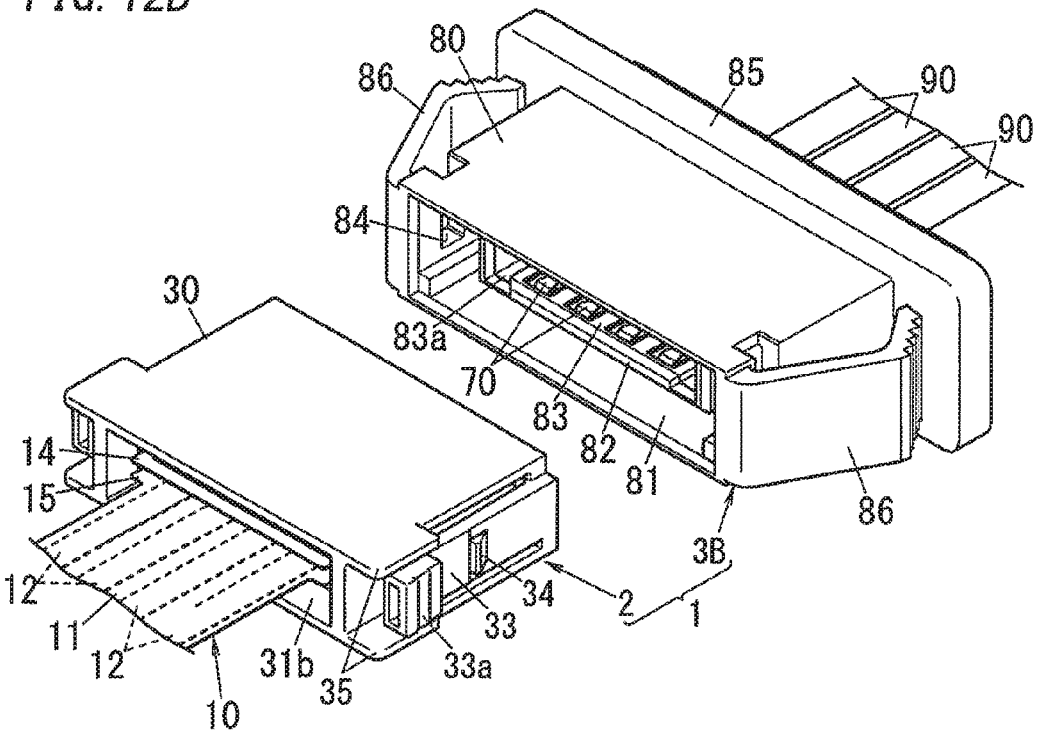
FIG. 12B is a perspective view of the connector device of the present embodiment wherein the electrical connection device is detached from the receptacle connector.

There is a flange 85 protruding from an outer periphery of rear part of the second housing 80. Further, there are engaging pieces 86 which protrude rearward and are formed integrally with front ends of left and right side walls of the second housing 80. The engaging piece 86 has a V shape when viewed in the upward and downward direction, and central part thereof in the forward and rearward direction protrudes outward. As shown in FIG. 12A, when the second housing 80 is inserted into a rectangular hole 101 provided to an attachment panel 100 from the back of the attachment panel 100, the left and right engaging pieces 86 come in contact with an end face of the hole 101 and are deformed inward. Subsequently, when the second housing 80 is pressed into the hole 101 until a front face of the flange 85 is in contact with a rear face of the attachment panel 100, outmost part of the engaging piece 86 is positioned in front of the hole 101 and thus the engaging piece 86 moves outward until it comes into contact with the end face of the hole 101. Therefore, the attachment panel 100 is held between the flange 85 and the engaging piece 86, and thereby the second housing 80 is positioned in the forward and rearward direction and the left and right direction. Accordingly, the second housing 80 is attached to the attachment panel 100.

The hollow cuboidal part 82 of the second housing 80 supports the multiple terminals 70 individually corresponding to the multiple electric conductors 12 of the flat cable 10 supported on the cable holding member 20.

Figure 17A:
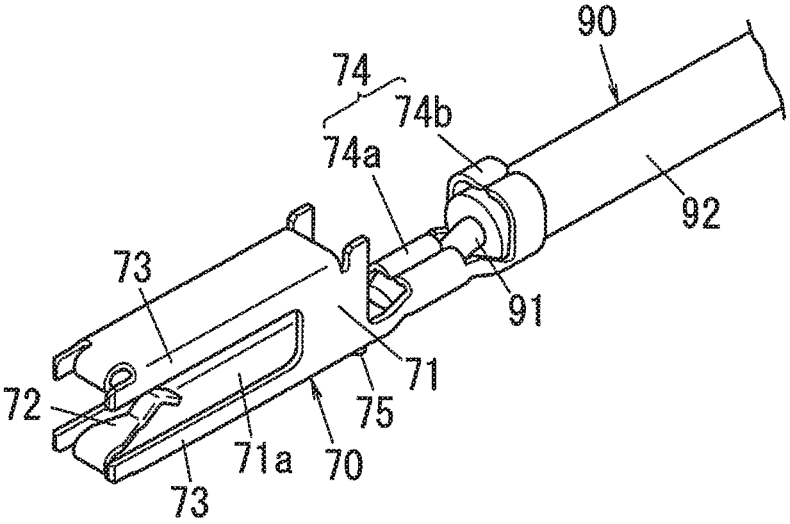
FIG. 17A and FIG. 17B are perspective views of appearance of a terminal of the receptacle connector used in the connector device of the present embodiment.
Figure 17B:
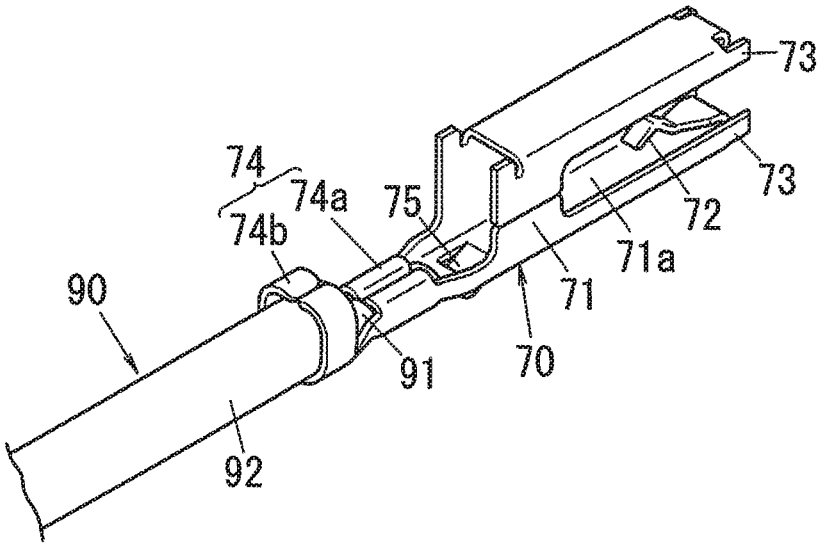

As shown in FIG. 17A and FIG. 17B, the terminal 70 is formed of a metal plate by bending, and includes a fixed part 71, a pair of contacts 72, and two pairs of side wall parts 73. Further, the receptacle connector 3B is of a cable connection type, and therefore the terminal 70 includes an electric cable connecting part 74. The terminal 70 is formed of a metal plate by perforating and bending, and includes the fixed part 71, the pair of contacts 72, the two pairs of side wall parts 73, and the electric cable connecting part 74 which are formed integrally.

The fixed part 71 is made of a metal plate by bending and has a hollow cylindrical or prism shape elongated in the forward and rearward direction. There are slits 71*a* with open rear ends formed in left and right side pieces of the fixed part 71.

The contacts 72 protrude forward from rear ends of an upper piece and a lower piece of the fixed part 71 individually. The pair of contacts 72 are arranged on the upper and lower sides of the slits 71*a* so that the slits 71*a* are present between the pair. The contacts 72 are formed by bending so as to incline so as to be close to each other toward their front ends. The contacts 72 are flexible in the upward and downward direction. The pair of contacts 72 holds the flat cable 10 supported on the cable holding member 20 from the opposite sides of the flat cable 10, and are in elastic contact with a corresponding one of the electric conductors 12 of the flat cable 10.

The pair of side wall parts 73 are formed on upper side and lower side of each of left and right side piece of the fixed part 71 so that the slit 71*a* is present between the pair of side wall parts 73. The side wall parts 73 are positioned on sides of the contacts 72 in a direction (left and right direction) across a direction in which the contacts 72 change in shape. Apparently, the side wall parts 73 are positioned on the sides of the contacts 72, and therefore a probability that something strikes the contacts 72 from their sides can be reduced, and thus it is possible to protect the contacts 72.

The electric cable connecting part 74 protrudes forward from the front end of the lower piece of the fixed part 71. The electric cable connecting part 74 includes a swaged piece 74*a* for fixing a core cable 91 of the electric cable 90 by swaging, and a swaged piece 74*b* for fixing an insulating cover 92 of the electric cable 90 by swaging. The core cable 91 is fixed by swaging to the swaged piece 74*a* of the electric cable connecting part 74, and thereby the terminal 70 is electrically connected to the core cable 91. Further, the insulating cover 92 is fixed by swaging to the swaged piece 74*b* of the electric cable connecting part 74, the terminal 70 is mechanically connected to the electric cable 90.

Figure 13:
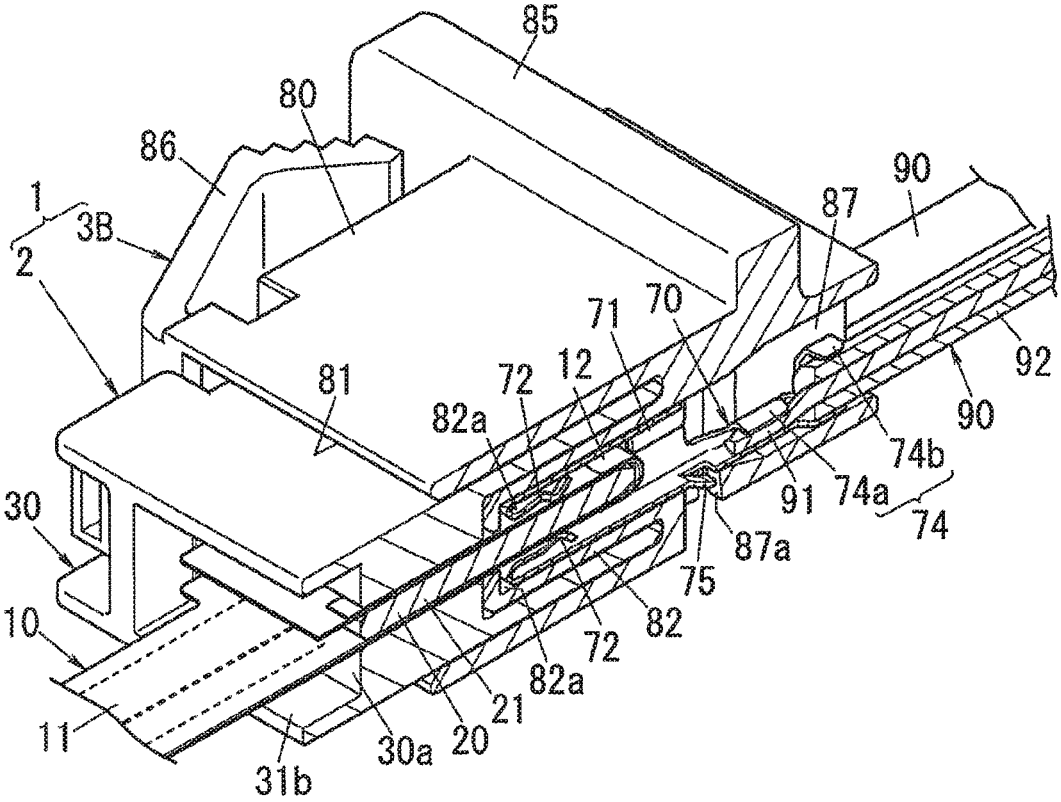
FIG. 13 is a perspective sectional view of the connector device of the present embodiment from the right side.
Figure 14:
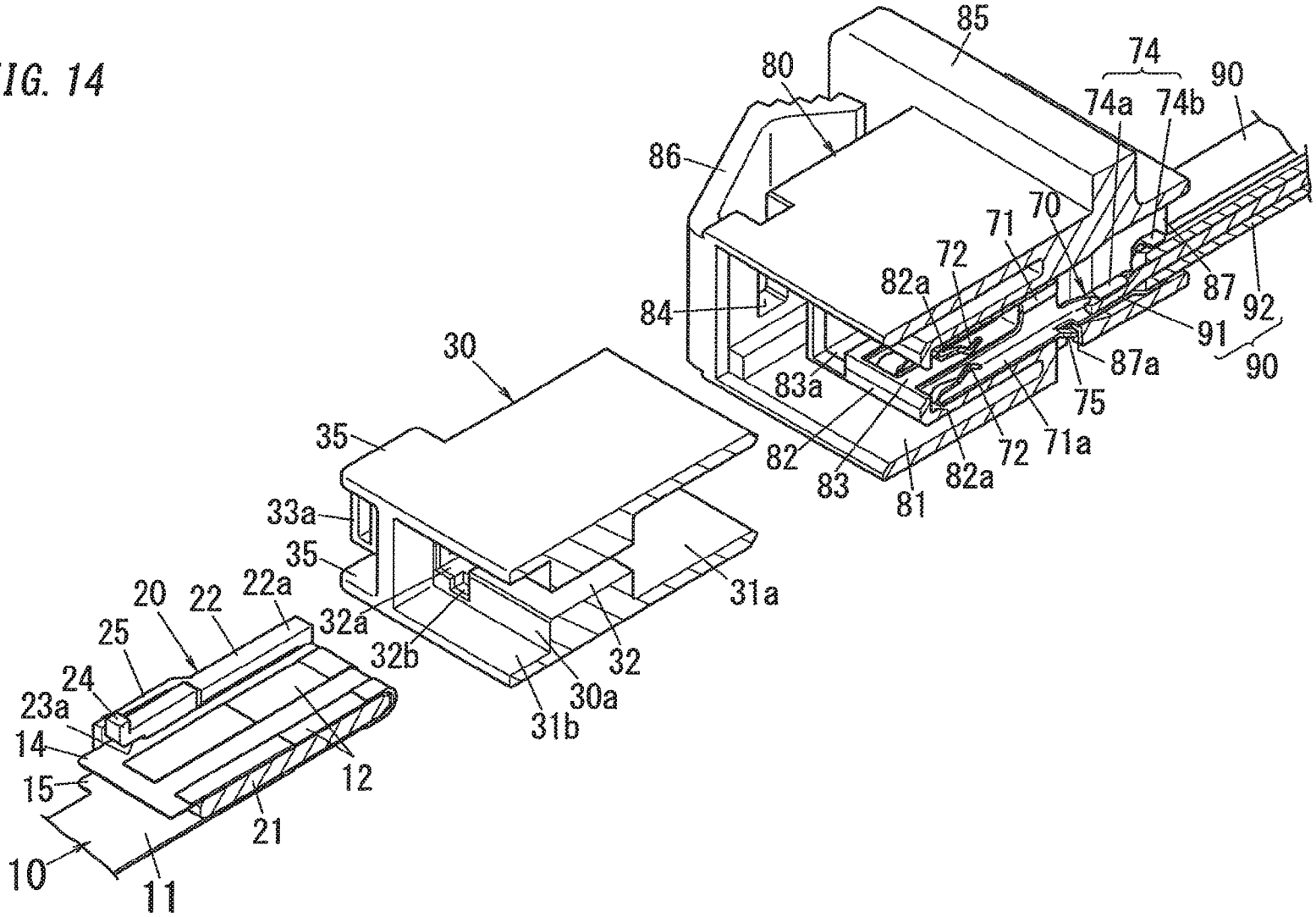
FIG. 14 is an exploded perspective sectional view of the connector device of the present embodiment from the right side.
Figure 15:
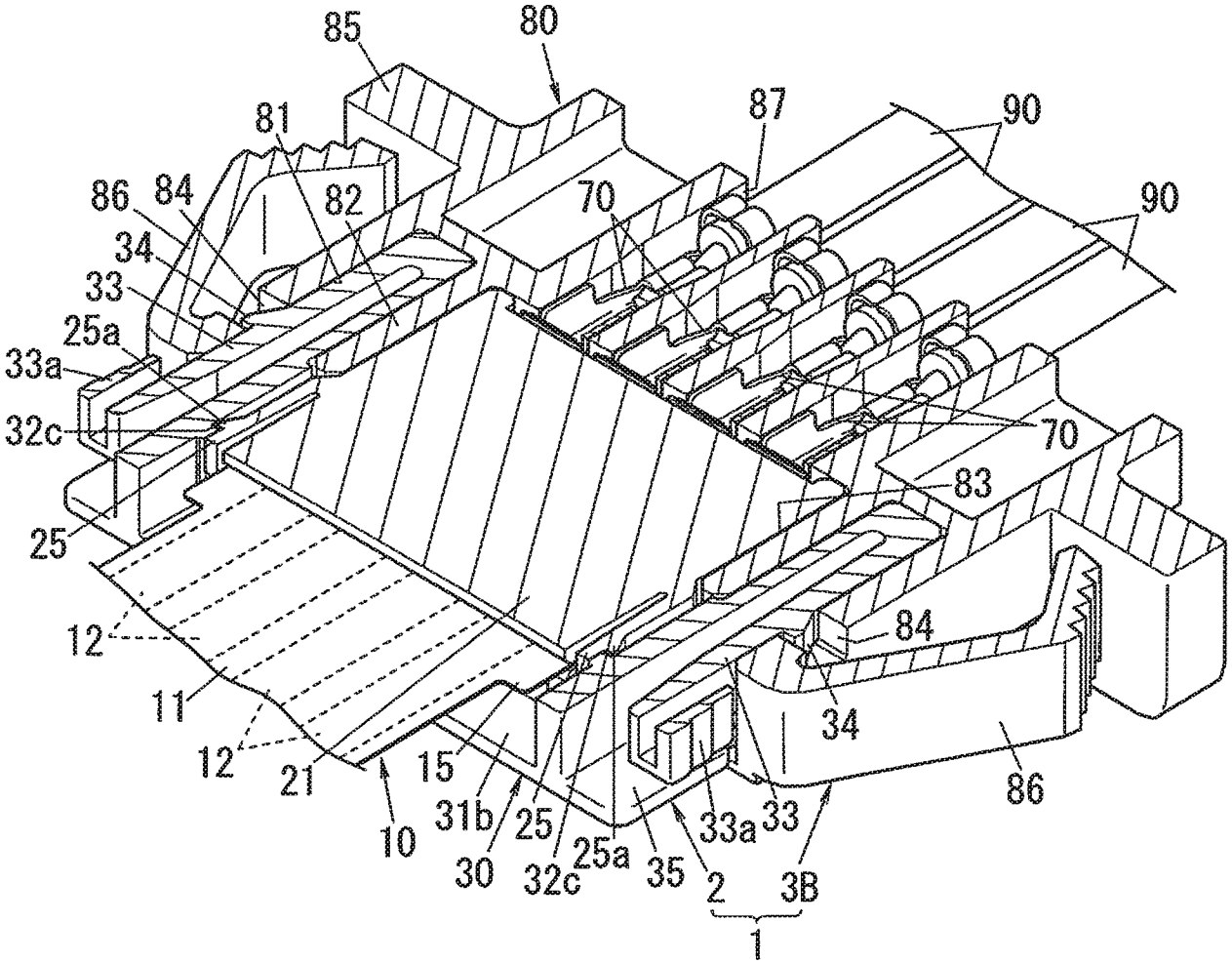
FIG. 15 is a perspective sectional view of the connector device of the present embodiment from the top side.
Figure 16:
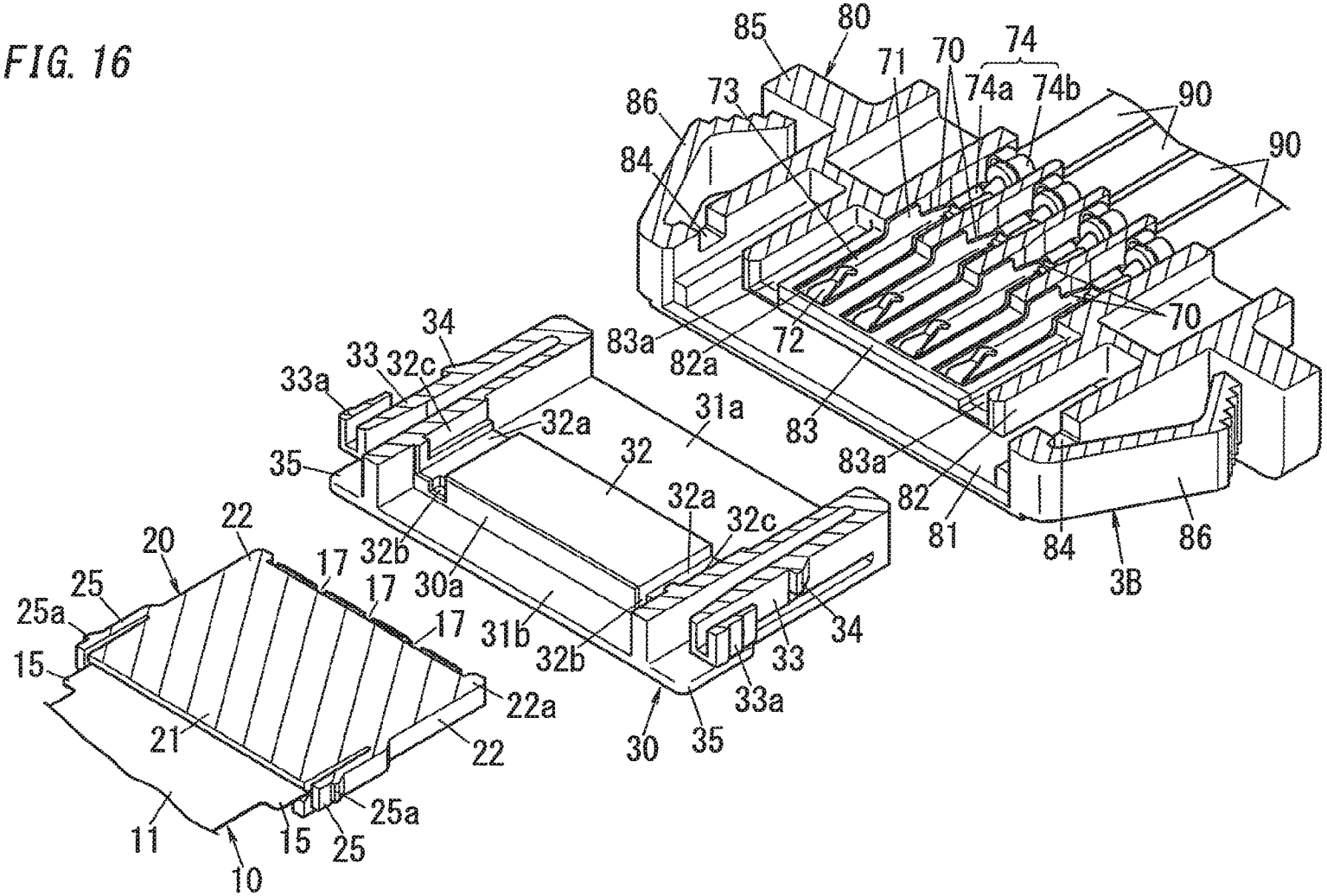
FIG. 16 is an exploded perspective sectional view of the connector device of the present embodiment from the top side.

The terminal 70 connected to the electric cable 90 is fixed to the receptacle connector 3B as follows. The worker inserts the terminal 70 into a hole 87 formed in the front wall of the second housing 80, with the contact 72 facing the hole 87. Then, the fixed part 71 is engaged with the internal wall of the hole 87, and thereby the terminal 70 is fixed to the second housing 80. Further, as shown in FIG. 13, there is a claw 75 formed at the lower piece of the fixed part 71 by cutting and bending. The claw 75 is fitted in an engaged hole 87*a* provided to an internal wall of the hole 87, and thereby the terminal 70 is held inside the hole 87. There are grooves 82*a* formed in an upper side face and a lower side face facing the fitting hole 83 of the hollow cuboidal part 82, and the terminals 70 inserted via the hole 87 are situated in the grooves 82*a* one-by-one. When the fixed part 71 of the terminal 70 is fixed to the second housing 80, each contact 72 is positioned inside a corresponding one of the grooves 82*a*, the pair of contacts 72 of the terminal 70 face each other in the upward and downward direction with the fitting hole 83 in-between.

The connector device 1 of the present embodiment has the aforementioned configuration, and the electrical connection device 2 is attached to or detached from the receptacle connector 3B in the following manners.

When the first housing 30 of the electrical connection device 2 is inserted into the insertion opening 81 of the second housing 80 of the receptacle connector 3B, the hollow cuboidal part 82 of the second housing 80 is inserted into the insertion opening 31*a* in the front of the first housing 30. In this regard, the front part of the cable holding member 20 is inserted into the fitting hole 83 of the hollow cuboidal part 82, and the flat cable 10 supported on the upper and lower faces of the supporting part 21 is inserted between the pair of contacts 72. Since the electrically conductive parts 12*a* are provided to parts of the flat cable 10 to be situated on the upper face and the lower face of the supporting part 21 (shown in FIG. 8 to FIG. 10), the pair of contacts 72 are in contact with the electrically conductive parts 12*a* from above and below, and thereby the electric conductors 12 are electrically connected to the terminals 70. Further, when the first housing 30 is inserted into the insertion opening 81 of the second housing 80 to a predetermined position, the claws 34 of the first housing 30 are fitted into the holes 84 of the second housing 80, and thereby connection between the electrical connection device 2 and the receptacle connector 3B is maintained.

To detach the electrical connection device 2 from the receptacle connector 3B, the worker touches the manipulation parts 33*a* provided to the first housing 30 and deform the left and right movable pieces 33 inward. Thereby, the claws 34 move outside the holes 84, and then connection between the claws 34 and the holes 84 are canceled. In this state, the worker can detach the first housing 30 from the second housing 80 by pulling the first housing 30 rearward. Apparently, it is possible to easily detach the electrical connection device 2 from the receptacle connector 3B.

As described above, the connector device 1 of the present embodiment includes the aforementioned electrical connection device 2, and the receptacle connector 3B including the multiple terminals 70 and the second housing 80 which supports the multiple terminals 70 and is to be removably connected to the electrical connection device 2. Each of the multiple terminals 70 includes the fixed part 71, the at least one contact 72, and the at least one side wall part 73, which are formed integrally. The fixed part 71 is fixed to the second housing 80. The at least one contact 72 is in a plate spring shape. While the electrical connection device 2 is connected to the receptacle connector 3B, the at least one contact 72 is in elastic contact with a corresponding one of the multiple electrically conductive members (the electric conductors 12) so as to be electrically connected to the corresponding one of the electrically conductive members (the electric conductors 12). The at least one side wall part 73 is on a side of the at least one contact 72 in a direction across a direction in which the at least one contact 72 is changes in shape.

Therefore it is possible to realize the connector device 1 including the cable holding member 20 with the improved resistance to pull-out of the flat cable 10. Further, in the terminal 70 of the receptacle connector 3B, the side wall part 73 is present on a side of the contact 72 in the direction across the direction in which the contact 72 changes in shape, and therefore something hardly strikes the contact 72 from side and thus the contact 72 can be protected. Note that, the terminal 50 for a surface-mounted type shown in FIG. 7A and FIG. 7B does not include any side wall part, but the terminal 50 for a surface-mounted type may include a side wall part on a side of the contact 72 in a direction across a direction in which the contact 52 changes in shape, and this can lead to protect of the contact 52.

Further, in the connector device 1 of the present embodiment, each of the multiple electrically conductive members (the multiple electric conductors 12) is present on the front side and the rear side of the supporting part 21 in a state where the flat cable 10 is supported on the supporting part 21. Further, each of the multiple terminals 70 corresponding to the multiple electrically conductive members (the electric conductors 12) includes the pair of contacts 72 to be in contact with a corresponding one of the multiple electrically conductive members (the electric conductors 12) present on the front side and the rear side of the supporting part 21 with the supporting part 21 in-between.

Apparently, the flat cable 10 is sandwiched between the two contacts 72, and thereby the contacts 72 are in elastic contact with the electric conductors 12 individually. Hence, contact between the contacts 72 and the electric conductors 12 is unsusceptible to deterioration with age, thermal deformation, and the like of molded products. Further, when the two contacts 72 are formed in the same shape, the flat cable 10 is centered between the two contacts 72, and therefore contact forces between the two contacts 72 and the corresponding electric conductors 12 can be made to be equal to each other.

Note that, in the connector devices 1 of the substrate-mounted type and the cable connection type described above, the flat cable 10 has part to be bent when supported on the supporting part 21, and the part is provided with a flexible structure for making the part more flexible than a remaining part of the flat cable 10. When the flexible structure is provided, the part of the flat cable 10 to be bent is more flexible than the remaining part of the flat cable 10, and this can lead to a decrease in stress on the substrate 11 which will occur in bending the flat cable 10.

In this regard, the flexible structure is defined as a penetrating structure in which at least one of one or more holes 17 and one or more cut-outs 18 is formed at the part of the flat cable 10 to be bent when supported on the supporting part 21 so as to penetrate the flat cable 10 in the thickness direction of the flat cable 10. The presence of the hole(s) 17 and the cut-out(s) 18 can lead to an increase in flexibility of the flat cable 10. Shapes of the hole 17 and the cut-out 18 and the numbers of holes 17 and cut-outs 18 may not be limited to those of the present embodiment, but may be modified appropriately providing that desired flexibility can be obtained. The penetrating structure may include only the hole(s) 17 or only the cut-out(s) 18.

Note that, the flexible structure is not limited to the penetrating structure in which at least one of one or more holes 17 and one or more cut-outs 18 is formed to penetrate the flat cable 10 in the thickness direction of the flat cable 10. The flexible structure may be a different structure.

For example, the flexible structure is defined as a thin structure obtained by making the part of the flat cable 10 to be bent when supported on the supporting part 21 be thinner than a remaining part of the flat cable 10. The part made to be thin is more flexible than the remaining part, and this can lead to a decrease in stress on the flat cable 10 which will occur in supporting the flat cable 10 on the supporting part 21.

The reinforcing part 13 in a film shape is provided to the surface of the flat cable 10. However, to improve the flexibility, the reinforcing part 13 is not provided to the surface of the flat cable 10 with regard to the part to be bent when supported on the supporting part 21. In this case, the flexible structure is defined as a structure in which the reinforcing part 13 is not provided to the surface of the flat cable with regard to the part to be bent when supported on the supporting part 21. This can lead to a decrease in stress on the flat cable 10 which will occur in supporting the flat cable 10 on the supporting part 21.

Note that, obviously, to an extent of the objective and the scope of the present invention, embodiments thereof can be modified in various ways, and accordingly the present invention is not limited to a specific one of possible embodiments.

The invention claimed is:

1. A cable holding member for holding a flat cable in a strip shape including a substrate where multiple electrically conductive members are arranged side by side in a width direction of the flat cable, and at least one first protrusion protruding outward in the width direction of the flat cable from a side edge of the substrate in the width direction of the flat cable, the cable holding member comprising:

a supporting part including a supporting face for supporting the flat cable in a folded state; and at least one wall part provided to the supporting part so as to be on at least one of opposite sides of the flat cable in the width direction of the flat cable supported on the supporting part, and at least one groove for receiving the at least one first protrusion of the flat cable being provided to the at least one wall part.

2. The cable holding member of claim 1, wherein a second protrusion to be fitted into a hole provided to the flat cable is provided to the supporting part.

3. The cable holding member of claim 2, wherein the at least one groove provided to the at least one wall part and the second protrusion are provided in different positions in a length direction of the flat cable which is perpendicular to the width direction of the flat cable.

4. The cable holding member of claim 1, wherein:

the at least one groove provided to the at least one wall part includes a first groove provided to an internal face of the at least one wall part on a front side of the supporting part, and a second groove provided to the internal face of the at least one wall part on a rear side of the supporting part; and with regard to the at least one wall part, the first groove and the second groove are provided respectively on the front side and the rear side of the supporting part to be in a same position when viewed in a thickness direction of the flat cable supported on the supporting part.

5. The cable holding member of claim 1, wherein the at least one groove is shaped to receive the at least one first protrusion in a width direction of the flat cable.

6. The cable holding member of claim 1, wherein an opening dimension of the at least one groove in a thickness direction of the flat cable supported on the supporting part is equal to a thickness of the flat cable.

7. The cable holding member of claim 1, wherein:

the first housing has a hollow cylindrical or prism shape with opposite open ends one of which defines a fitting hole; and a guiding part for guiding insertion of the cable holding member into the fitting hole in inserting the cable holding member into the fitting hole is provided to an end of the at least one wall part in an insertion direction in which the cable holding member is inserted into the fitting hole.

8. The cable holding member of claim 1, wherein:

the at least one wall part includes a pair of wall parts; and the pair of wall parts are provided to the supporting art so as to be on the opposite sides of the flat cable in the width direction of the flat cable supported on the supporting part.

9. An electrical connection device comprising:

the cable holding member of claim 1; and a first housing with a hollow cylindrical or prism shape with opposite open ends, the first housing holding the cable holding member which is inserted into the first housing via a first one of the open ends while the flat cable is supported thereon, and the first housing making, when a receptacle connector including a second housing supporting multiple terminals corresponding to the multiple electrically conductive members is inserted into the first housing via a second one of the open ends with the multiple terminals being directed to the first housing, electrical connection between the multiple terminals and corresponding ones of the multiple electrically conductive members.

10. A connector device comprising:

the electrical connection device of claim 9; and the receptacle connector including the multiple terminals and the second housing which supports the multiple terminals and is to be removably connected to the electrical connection device, each of the multiple terminals including a fixed part, at least one contact, and at least one side wall part which are formed integrally, the fixed part being fixed to the second housing, the at least one contact being in a plate spring shape which is to be electrically connected to a corresponding one of the multiple electrically conductive members when coming into elastic contact with the corresponding one of the multiple electrically conductive members while the electrical connection device is connected to the receptacle connector, and the at least one side wall part being on a side of the at least one contact in a direction across a direction in which the at least one contact changes in shape.

11. The connector device of claim 10, wherein:

each of the multiple electrically conductive members is present on a front side and a rear side of the supporting part in a state where the flat cable is supported on the supporting part; and each of the multiple terminals corresponding to the multiple electrically conductive members includes, as the at least one contact, a pair of contacts to be in contact with a corresponding one of the multiple electrically conductive members present on the front side and the rear side of the supporting part with the supporting part in-between.

12. The cable holding member of claim 10, wherein the flat cable has part to be bent when supported on the supporting part, and the part being provided with a flexible structure for making the part more flexible than a remaining part of the flat cable.

13. The connector device of claim 12, wherein the flexible structure is defined as a penetrating structure in which at least one of one or more holes and one or more cut-outs is formed at the part of the flat cable to be bent when supported on the supporting part so as to penetrate the flat cable in a thickness direction of the flat cable.

14. The connector device of claim 12, wherein the flexible structure is defined as a thin structure obtained by making the part of the flat cable to be bent when supported on the supporting part be thinner than a remaining part of the flat cable.

15. The connector device of claim 12, wherein:

a reinforcing part in a film shape is provided to a surface of the flat cable except the part to be bent when supported on the supporting part; and the flexible structure is defined as a structure in which the reinforcing part is not provided to the surface of the flat cable with regard to the part to be bent when supported on the supporting part.

16. A flat cable in a strip shape to be supported in a folded state on the supporting part of the cable holding member of claim 1, the flat cable comprising:

a substrate where multiple electrically conductive members are arranged side by side in a width direction of the flat cable; and at least one first protrusion protruding outward in the width direction of the flat cable from a side edge of the substrate in the width direction of the flat cable, the substrate having part to be bent when supported on the supporting part, and the part being provided with a flexible structure for making the part more flexible than a remaining part of the substrate.

17. The flat cable of claim 16, wherein the flexible structure is defined as a penetrating structure in which at least one of one or more holes and one or more cut-outs is formed at the part to be bent when supported on the supporting part so as to penetrate the flat cable in a thickness direction of the flat cable.

18. The flat cable of claim 16, wherein the flexible structure is defined as a thin structure obtained by making the part to be bent when supported on the supporting part be thinner than the remaining part of the flat cable.

19. The flat cable of claim 16, wherein:

a reinforcing part in a film shape is provided to a surface of the substrate except the part to be bent when supported on the supporting part; and the flexible structure is defined as a structure in which the reinforcing part s not provided to the part to be bent when supported on the supporting part with regard to the surface of the substrate.

* * * * *